US009557672B2

(12) United States Patent
Chiba et al.

(10) Patent No.: US 9,557,672 B2
(45) Date of Patent: Jan. 31, 2017

(54) TONER, DEVELOPER, AND IMAGE FORMING APPARATUS

(71) Applicants: Susumu Chiba, Shizuoka (JP); Tsuyoshi Sugimoto, Shizuoka (JP); Shinya Nakayama, Shizuoka (JP); Kohsuke Nagata, Shizuoka (JP); Shinsuke Nagai, Shizuoka (JP); Daisuke Asahina, Shizuoka (JP)

(72) Inventors: Susumu Chiba, Shizuoka (JP); Tsuyoshi Sugimoto, Shizuoka (JP); Shinya Nakayama, Shizuoka (JP); Kohsuke Nagata, Shizuoka (JP); Shinsuke Nagai, Shizuoka (JP); Daisuke Asahina, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/913,606

(22) PCT Filed: Aug. 13, 2014

(86) PCT No.: PCT/JP2014/071690

§ 371 (c)(1),
(2) Date: Feb. 22, 2016

(87) PCT Pub. No.: WO2015/033773

PCT Pub. Date: Mar. 12, 2015

(65) Prior Publication Data

US 2016/0209766 A1 Jul. 21, 2016

(30) Foreign Application Priority Data

Sep. 6, 2013 (JP) ..... 2013-185200

(51) Int. Cl.
*G03G 9/087* (2006.01)

(52) U.S. Cl.
CPC ..... *G03G 9/08755* (2013.01); *G03G 9/08793* (2013.01); *G03G 9/08795* (2013.01); *G03G 9/08797* (2013.01)

(58) Field of Classification Search
CPC ..... G03G 9/08755
See application file for complete search history.

(56) References Cited

U.S. PATENT DOCUMENTS

| | | | |
|---|---|---|---|
| 7,261,989 | B2 | 8/2007 | Sugiura et al. |
| 7,318,989 | B2 | 1/2008 | Kotsugai et al. |
| 7,455,942 | B2 | 11/2008 | Nagatomo et al. |
| 8,673,528 | B2 | 3/2014 | Sugimoto et al. |
| 2004/0072091 | A1 | 4/2004 | Mochizuki et al. |
| 2004/0115550 | A1 | 6/2004 | Sugiura et al. |
| 2005/0026064 | A1 | 2/2005 | Sugiura et al. |
| 2005/0089786 | A1 | 4/2005 | Sugiura et al. |
| 2005/0089787 | A1 | 4/2005 | Uchinokura et al. |
| 2005/0208408 | A1 | 9/2005 | Uchinokura et al. |
| 2006/0029433 | A1 | 2/2006 | Saito et al. |
| 2007/0218391 | A1 | 9/2007 | Yamada et al. |
| 2008/0014527 | A1 | 1/2008 | Kotsugai et al. |
| 2008/0070151 | A1 | 3/2008 | Sugimoto et al. |
| 2008/0118855 | A1 | 5/2008 | Nakayama et al. |
| 2008/0227002 | A1 | 9/2008 | Moriya et al. |
| 2008/0261131 | A1 | 10/2008 | Nakayama et al. |
| 2008/0280218 | A1 | 11/2008 | Sabu et al. |
| 2008/0280219 | A1 | 11/2008 | Nakayama et al. |
| 2008/0318143 | A1 | 12/2008 | Nakayama et al. |
| 2008/0318144 | A1 | 12/2008 | Watanabe et al. |
| 2008/0318148 | A1 | 12/2008 | Sugimoto et al. |
| 2009/0074467 | A1 | 3/2009 | Seshita et al. |
| 2009/0092917 | A1 | 4/2009 | Sugimoto et al. |
| 2009/0104555 | A1 | 4/2009 | Wakamatsu et al. |
| 2009/0214973 | A1 | 8/2009 | Sugimoto et al. |
| 2009/0325099 | A1 | 12/2009 | Watanabe et al. |
| 2010/0035170 | A1 | 2/2010 | Sugimoto et al. |
| 2011/0123922 | A1 | 5/2011 | Yamane et al. |
| 2011/0262856 | A1 | 10/2011 | Sugimoto et al. |
| 2011/0281213 | A1 | 11/2011 | Sakashita et al. |
| 2012/0052434 | A1 | 3/2012 | Sugimoto et al. |
| 2012/0064447 | A1 | 3/2012 | Hozumi et al. |
| 2012/0065357 | A1 | 3/2012 | Yamauchi et al. |

(Continued)

FOREIGN PATENT DOCUMENTS

| | | | |
|---|---|---|---|
| EP | 2 381 313 | A1 | 10/2011 |
| JP | 62-299859 | A | 12/1987 |
| JP | 2579150 | B | 11/1996 |
| JP | 11-133665 | A | 5/1999 |
| JP | 2001-158819 | A | 6/2001 |
| JP | 2002-287400 | A | 10/2002 |
| JP | 2002-351143 | A | 12/2002 |
| JP | 2004-046095 | A | 2/2004 |
| JP | 2006-003681 | | 1/2006 |
| JP | 2006-293338 | A | 10/2006 |
| JP | 2007-249079 | A | 9/2007 |
| JP | 2007-271789 | A | 10/2007 |
| JP | 2007-293045 | A | 11/2007 |
| JP | 2008-281882 | A | 11/2008 |

(Continued)

OTHER PUBLICATIONS

International Search Report Issued on Oct. 7, 2014 for PCT/JP2014/071690 filed Aug. 13, 2014.

(Continued)

*Primary Examiner* — Hoa V Le
(74) *Attorney, Agent, or Firm* — Oblon, McClelland, Maier & Neustadt, L.L.P.

(57) ABSTRACT

A toner, including: a polyester resin, wherein the polyester resin includes a diol component and a crosslink component as constituent components thereof, wherein the diol component contains an aliphatic diol having 3 to 10 carbon atoms in an amount of 50 mol % or more, wherein the crosslink component contains a trihydric or higher aliphatic alcohol, and wherein the toner has a glass transition temperature (Tg1st) of 20° C. to 50° C., where the glass transition temperature (Tg1st) is measured in first heating in differential scanning calorimetry (DSC) of the toner.

9 Claims, 4 Drawing Sheets

(56) References Cited

U.S. PATENT DOCUMENTS

| | | | |
|---|---|---|---|
| 2012/0082926 | A1 | 4/2012 | Suzuki et al. |
| 2012/0282000 | A1 | 11/2012 | Nakayama et al. |
| 2012/0295193 | A1 | 11/2012 | Hanatani et al. |
| 2013/0045442 | A1 | 2/2013 | Moriya et al. |
| 2013/0059247 | A1 | 3/2013 | Sugimoto et al. |
| 2013/0078563 | A1 | 3/2013 | Nakayama et al. |
| 2013/0095422 | A1 | 4/2013 | Yamamoto et al. |
| 2013/0108950 | A1 | 5/2013 | Yamamoto et al. |
| 2013/0115550 | A1 | 5/2013 | Amemori et al. |
| 2013/0143155 | A1 | 6/2013 | Santo et al. |
| 2013/0157183 | A1 | 6/2013 | Santo et al. |
| 2013/0157185 | A1 | 6/2013 | Sakashita et al. |
| 2013/0157193 | A1 | 6/2013 | Moritani et al. |
| 2013/0236826 | A1 | 9/2013 | Makabe et al. |
| 2013/0244011 | A1 | 9/2013 | Sabu et al. |
| 2013/0244153 | A1 | 9/2013 | Nakayama et al. |
| 2013/0244154 | A1 | 9/2013 | Yamamoto et al. |
| 2013/0244168 | A1 | 9/2013 | Yamashita et al. |
| 2013/0252158 | A1 | 9/2013 | Yamada et al. |
| 2013/0260298 | A1 | 10/2013 | Amemori et al. |
| 2013/0337374 | A1 | 12/2013 | Sugimoto et al. |
| 2014/0023965 | A1 | 1/2014 | Chiba et al. |
| 2014/0051019 | A1 | 2/2014 | Sekiguchi et al. |
| 2014/0065534 | A1 | 3/2014 | Amemori et al. |
| 2014/0080046 | A1 | 3/2014 | Asahina et al. |
| 2014/0080050 | A1 | 3/2014 | Asahina et al. |
| 2014/0270874 | A1 | 9/2014 | Hase et al. |
| 2014/0272689 | A1 | 9/2014 | Yamashita et al. |
| 2014/0301757 | A1 | 10/2014 | Sakashita et al. |
| 2015/0072287 | A1* | 3/2015 | Amemori ..... G03G 9/08755 430/109.4 |

FOREIGN PATENT DOCUMENTS

| | | | |
|---|---|---|---|
| JP | 2010-20170 | | 1/2010 |
| JP | 2011-237663 | A | 11/2011 |
| JP | 2013-054178 | | 3/2013 |
| WO | WO2006/095901 | A1 | 9/2006 |

OTHER PUBLICATIONS

Extended European Search Report issued Jul. 15, 2016 in Patent Application No. 14841826.2.

Japanese Information Offer Form dated Aug. 15, 2016 in Japanese Patent Application No. 2013-185200 with English Translation.

* cited by examiner

TONER, DEVELOPER, AND IMAGE FORMING APPARATUS

TECHNICAL FIELD

The present invention relates to a toner, a developer, and an image forming apparatus.

BACKGROUND ART

In recent years, toners have been desired to have small particles size and hot offset resistance for giving high quality output images, low temperature fixing ability for energy saving, and heat resistant storage stability for resisting high-temperature, high-humidity environments during storage or transport after production. Particularly, low temperature fixing ability is very important quality of a toner, as power consumption for fixing occupies a large part in the power consumption for an entire image forming process.

Conventionally, toners produced by a kneading and pulverizing method have been used. The toner produced by the kneading and pulverizing method have problems that it is difficult to reduce the particle size thereof, and shapes of particles are uneven and a particle diameter distribution thereof is broad, which result in unsatisfactory quality of output images, and a large quantity of energy is required for fixing such toner. In the case where wax (i.e., a releasing agent) is added to the toner for improving fixing ability, moreover, the toner produced by the kneading and pulverizing method contains a large amount of the wax present near toner surfaces, as a kneaded product is cracked from an interface of wax during pulverizing. As a result of this, a releasing effect is exhibited, but on the other hand, the toner tends to cause toner deposition (i.e., filming) on a carrier, a photoconductor, and a blade. Therefore, such toner is not satisfactory in view of its characteristics on the whole.

To encounter the aforementioned problems associated with the kneading and pulverizing method, a production method of a toner in accordance with a polymerization method has been proposed. A toner produced by the polymerization method is easily produced as small particles, has a sharp particle diameter distribution compared to that of the toner produced by the pulverizing method, and can encapsulate a releasing agent therein. As a production method of a toner in accordance with the polymerization method, proposed is a method for producing a toner using an elongation reaction product of urethane-modified polyester as a toner binder, for the purpose of improving low temperature fixing ability, and hot offset resistance (see PTL 1).

Moreover, proposed is a production method of a toner, which is excellent in all of heat resistant storage stability, low temperature fixing ability, and hot offset resistance, as well as excellent in powder flowability and transfer ability, when a toner is produced as a small-diameter toner (see PTLs 2 and 3).

Further, disclosed is a production method of a toner having a maturing step for producing a toner binder having a stable molecular weight distribution, and achieving both low temperature fixing ability and (see PTLs 4 and 5).

However, these proposed techniques do not provide a toner having a high level of low temperature fixing ability, which has been demanded in recent years.

For the purpose of achieving a high level of low temperature fixing ability, therefore, proposed is a toner containing a resin including a crystalline polyester resin, and a releasing agent, and having a phase separation structure, where the resin and the releasing agent (e.g., wax) are incompatible to each other in the form of sea-islands (see PTL 6).

Moreover, proposed is a toner containing a crystalline polyester resin, a releasing agent, and a graft polymer (see PTL 7).

These proposed techniques can achieve low temperature fixing, as the crystalline polyester resin is rapidly melted, compared to a non-crystalline polyester resin. Even when the crystalline polyester resin, which forms islands in the sea-island phase separation structure, is melted, however, the non-crystalline polyester resin, which forms sea occupying the majority of the structure, is not yet melted. Since fixing cannot be carried out unless both the crystalline polyester resin, and the non-crystalline polyester resin are melted to a certain extent, these techniques do not achieve a high level of low temperature fixing ability, a level of which has been desired to be higher.

Also, although the recent demands for further improvements in qualities have required toners to be excellent not only in low temperature fixing ability, hot offset resistance, and heat resistant storage stability but also in image gloss and coloring ability, such toners have not been obtained.

Under such circumstances, there is currently a demand for a toner excellent not only in low temperature fixing ability, hot offset resistance, and heat resistant storage stability but also in image gloss and coloring ability.

CITATION LIST

Patent Literature

PTL 1: Japanese Patent Application Laid-Open (JP-A) No. 11-133665
PTL 2: JP-A No. 2002-287400
PTL 3: JP-A No. 2002-351143
PTL 4: Japanese Patent (JP-B) No. 2579150
PTL 5: JP-A No. 2001-158819
PTL 6: JP-A No. 2004-46095
PTL 7: JP-A No. 2007-271789

SUMMARY OF INVENTION

Technical Problem

The present invention aims to solve the above existing problems and achieve the following object; i.e., providing a toner excellent not only in low temperature fixing ability, hot offset resistance, and heat resistant storage stability but also in image gloss and coloring ability.

Solution to Problem

Means for solving the above problems are as follows.

That is, a toner of the present invention is a toner including a polyester resin, wherein the polyester resin includes a diol component and a crosslink component as constituent components thereof, wherein the diol component contains an aliphatic diol having 3 to 10 carbon atoms in an amount of 50 mol % or more, wherein the crosslink component contains a trihydric or higher aliphatic alcohol, and wherein the toner has a glass transition temperature (Tg1st) of 20° C. to 50° C., where the glass transition temperature (Tg1st) is measured in first heating in differential scanning calorimetry (DSC) of the toner.

Advantageous Effects of Invention

The present invention can solve the above existing problems and provide a toner excellent not only in low temperature fixing ability, hot offset resistance, and heat resistant storage stability but also in image gloss and coloring ability.

DESCRIPTION OF EMBODIMENTS (Toner)

Figure 1:
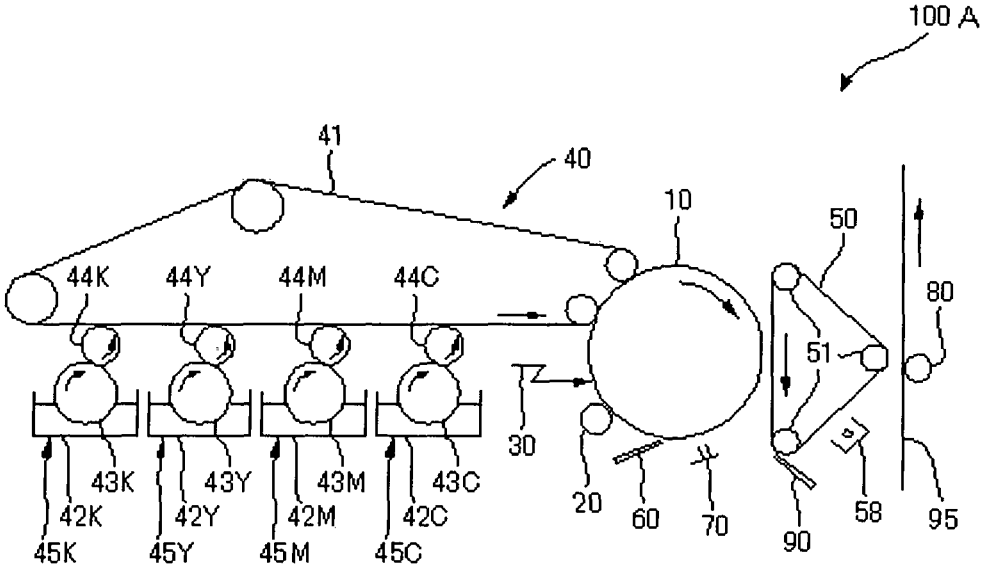
FIG. 1 is a schematic structural view of one example of an image forming apparatus of the present invention.

A toner of the present invention includes at least a polyester resin, preferably further includes a crystalline polyester resin, and if necessary, further includes other components such as a colorant.

The polyester resin contains a diol component and a crosslink component as constituent components thereof.

The diol component contains an aliphatic diol having 3 to 10 carbon atoms in an amount of 50 mol % or more.

The crosslink component contains a trihydric or higher aliphatic alcohol.

The toner has a glass transition temperature (Tg1st) of 20° C. to 50° C., where the glass transition temperature (Tg1st) is measured in first heating in differential scanning calorimetry (DSC) of the toner.

One conceivable method for improving low temperature fixing ability of a toner is lowering the glass transition temperature or the molecular weight of a polyester resin (e.g., a non-crystalline polyester resin) so that the polyester resin melt with a crystalline polyester resin. However, it can easily be imagined that when simply lowering the glass transition temperature or the molecular weight of the polyester resin to lower its melt viscosity, the resultant toner will be degraded in heat resistant storage stability and hot offset resistance upon fixing.

In the toner of the present invention, the polyester resin includes a diol component, and the diol component contains an aliphatic diol having 3 to 10 carbon atoms in an amount of 50 mol % or more. This diol component lowers the glass transition temperature and the melt viscosity, ensuring the low temperature fixing ability. In addition, the polyester resin contains a trihydric or higher aliphatic alcohol as a crosslink component. This trihydric or higher aliphatic alcohol makes the polyester resin have a branched structure in its molecular skeleton, so that the molecular chain thereof becomes a three-dimensional network structure. As a result, the polyester resin has such rubber-like properties as to deform at low temperature but not flow, enabling the toner to retain heat resistant storage stability and hot offset resistance.

It is also possible to use, for example, a trivalent or higher carboxylic acid or an epoxy as the crosslink component. In this case, however, a fixed image obtained by fixing the resultant with heat may not show sufficient glossiness since many trivalent or higher carboxylic acids are aromatic compounds or a density of ester bonds of the crosslink components becomes higher. Use of a crosslinking agent such as an epoxy needs crosslinking reaction after polymerization for the polyester, which makes it difficult to control the distance between crosslinked points, potentially leading to failure to obtain intended viscoelasticity and/or degradation in image density or glossiness due to unevenness in the fixed image. The reason why the unevenness in the fixed image arises is that the epoxy tends to react with an oligomer formed during the production of the polyester to form portions having a high crosslinked density.

<Polyester Resin>

The polyester resin contains a diol component and a crosslink component as constituent components, and preferably further, contains a dicarboxylic acid component as a constituent component.

The polyester resin is preferably a non-crystalline polyester resin.

The diol component in the polyester resin contains an aliphatic diol having 3 to 10 carbon atoms in an amount of 50 mol % or more, preferably 80 mol % or more, more preferably 90 mol % or more.

Examples of the aliphatic diol having 3 to 10 carbon atoms include 1,2-propylene glycol, 1,3-propylene glycol, 1,4-butanediol, 2-methyl-1,3-propanediol, 1,5-pentanediol, 3-methyl-1,5-pentanediol, 1,6-hexanediol, 1,8-octanediol, 1,10-decanediol, and 1,12-dodecanediol.

Preferably, the number of carbon atoms of the main chain of the diol component constituting the non-crystalline polyester resin which is one preferable example of the polyester resin is an odd number, and the diol component has an alkyl group in a side chain thereof.

Preferably, the number of carbon atoms of the main chain of the aliphatic diol having 3 to 10 carbon atoms is an odd number, and the aliphatic diol having 3 to 10 carbon atoms has an alkyl group in a side chain thereof. It is preferably an aliphatic diol represented by the following General Formula (1):

$$HO—(CR^1R^2)_n—OH \qquad \text{General Formula (1)}$$

where $R^1$ and $R^2$ each independently represent a hydrogen atom or an alkyl group having 1 to 3 carbon atoms, n is an odd number of 3 to 9, and in units repeated by n, $R^1$s may be identical to or different from each other and $R^2$s may be identical to or different from each other.

In the polyester resin, the crosslink component contains a trihydric or higher aliphatic alcohol, and preferably contains a trihydric or tetrahydric aliphatic alcohol from the viewpoints of obtaining good glossiness of a fixed image and good image density. The crosslink component may consist of the trihydric or higher aliphatic alcohol.

Examples of the trihydric or higher aliphatic alcohol include glycerin, trimethylolethane, trimethylolpropane, pentaerythritol, sorbitol, and dipentaerythritol.

An amount of the crosslink component in the constituent components of the polyester resin is not particularly limited and may be appropriately selected depending on the intended purpose, but is preferably 0.5% by mass to 5% by mass, more preferably 1% by mass to 3% by mass.

An amount of the trihydric or higher aliphatic alcohol in polyhydric alcohol components serving as the constituent components of the polyester resin is not particularly limited and may be appropriately selected depending on the intended purpose, but is preferably 50% by mass to 100% by mass, more preferably 90% by mass to 100% by mass.

In the polyester resin, the dicarboxylic acid component preferably contains an aliphatic dicarboxylic acid having 4 to 12 carbon atoms, and preferably contains the aliphatic dicarboxylic acid having 4 to 12 carbon atoms in an amount of 50 mol % or more.

Also, in the polyester resin, the dicarboxylic acid component preferably contains the aliphatic dicarboxylic acid having 4 to 12 carbon atoms in an amount of less than 60 mol %.

Examples of the aliphatic dicarboxylic acid having 4 to 12 carbon atoms include succinic acid, glutaric acid, adipic acid, pimelic acid, suberic acid, azelaic acid, sebacic acid, and decanedioic acid.

The polyester resins may be used alone or in combination with other polyester resins.

The other polyester resins include, for example, a diol component and a dicarboxylic acid component as constituent components thereof. Note that, the other polyester resins may or may not contain an aliphatic diol having 3 to 10 carbon atoms as the constituent components thereof. The other polyester resins may or may not contain the crosslink component as the constituent components thereof.

The polyester resin preferably contains a urethane bond, a urea bond, or both, since it is more excellent in adhesion onto recording media such as paper. Also, as a result of containing a urethane bond, a urea bond, or both in the polyester resin, the urethane bond or the urea bond behaves as a pseudo-crosslinking point to increase rubber-like properties of the polyester resin. As a result, the obtained toner is more excellent in heat resistant storage stability and hot offset resistance.

—Diol Component—

The diol component is not particularly limited and may be appropriately selected depending on the intended purpose. Examples thereof include aliphatic diols such as ethylene glycol, 1,2-propylene glycol, 1,3-propylene glycol, 1,4-butanediol, 2-methyl-1,3-propanediol, 1,5-pentanediol, 3-methyl-1,5-pentanediol, 1,6-hexanediol, 1,8-octanediol, 1,10-decanediol, and 1,12-dodecanediol; diols containing an oxyalkylene group such as diethylene glycol, triethylene glycol, dipropylene glycol, polyethylene glycol, polypropylene glycol and polytetramethylene glycol; alicyclic diols such as 1,4-cyclohexanedimethanol and hydrogenated bisphenol A; adducts of alicyclic diols with alkylene oxides such as ethylene oxide, propylene oxide, and butylene oxide; bisphenols such as bisphenol A, bisphenol F and bisphenol S; and adducts of bisphenols with alkylene oxides such as ethylene oxide, propylene oxide, and butylene oxide. Among them, aliphatic diols having 4 to 12 carbon atoms are preferred.

These diols may be used alone or in combination of two or more thereof.

—Dicarboxylic Acid Component—

The dicarboxylic acid component is not particularly limited and may be appropriately selected depending on the intended purpose. Examples thereof include aliphatic dicarboxylic acids and aromatic dicarboxylic acids. Besides, anhydrides thereof, lower (C1 to C3) alkyl-esterified compounds thereof, or halides thereof may also be used.

The aliphatic dicarboxylic acid is not particularly limited and may be appropriately selected depending on the intended purpose. Examples thereof include succinic acid, adipic acid, sebacic acid, decanedioic acid, maleic acid, and fumaric acid.

The aromatic dicarboxylic acid is not particularly limited and may be appropriately selected depending on the intended purpose. Examples thereof include phthalic acid, isophthalic acid, terephthalic acid, and naphthalenedicarboxylic acids. Among them, aliphatic dicarboxylic acids having 4 to 12 carbon atoms are preferred.

These dicarboxylic acids may be used alone or in combination of two or more thereof.

—Trihydric or Higher Aliphatic Alcohol—

The trihydric or higher aliphatic alcohol is not particularly limited and may be appropriately selected depending on the intended purpose. Examples thereof include glycerin, trimethylolethane, trimethylolpropane, pentaerythritol, sorbitol, and dipentaerythritol.

Among them, trihydric or tetrahydric aliphatic alcohols are preferred. These trihydric or higher aliphatic alcohols may be used alone or in combination of two or more thereof.

—Polyester Resin Containing a Urethane Bond, a Urea Bond, or Both—

The polyester resin containing a urethane bond, a urea bond, or both is not particularly limited and may be appropriately selected depending on the intended purpose. Examples thereof include a reaction product between an active hydrogen group-containing polyester resin and a polyisocyanate (the reaction product being preferably used as a reaction precursor to be reacted with the below-described curing agent (hereinafter may be referred to as "prepolymer")). The polyester resin containing a urethane bond, a urea bond, or both may be a reaction product between the above reaction product and the curing agent.

Examples of the active hydrogen group-containing polyester resin include a hydroxyl group-containing polyester resin.

—Polyisocyanate—

The polyisocyanate is not particularly limited and may be appropriately selected depending on the intended purpose. Examples thereof include diisocyanate, and trivalent or higher isocyanate.

Examples of the diisocyanate include: aliphatic diisocyanate; alicyclic diisocyanate; aromatic diisocyanate; aromatic aliphatic diisocyanate; isocyanurate; and a block product thereof where the foregoing compounds are blocked with a phenol derivative, oxime, or caprolactam.

The aliphatic diisocyanate is not particularly limited and may be appropriately selected depending on the intended purpose. Examples thereof include tetramethylene diisocyanate, hexamethylene diisocyanate, 2,6-diisocyanato methyl caproate, octamethylene diisocyanate, decamethylene diisocyanate, dodecamethylene diisocyanate, tetradecamethylene diisocyanate, trimethylhexane diisocyanate, and tetramethylhexane diisocyanate.

The alicyclic diisocyanate is not particularly limited and may be appropriately selected depending on the intended purpose. Examples thereof include isophorone diisocyanate, and cyclohexylmethane diisocyanate.

The aromatic diisocyanate is not particularly limited and may be appropriately selected depending on the intended purpose. Examples thereof include tolylene diisocyanate, diisocyanato diphenyl methane, 1,5-nephthylene diisocyanate, 4,4'-diisocyanato diphenyl, 4,4'-diisocyanato-3,3'-dimethyldiphenyl, 4,4'-diisocyanato-3-methyldiphenyl methane, and 4,4'-diisocyanato-diphenyl ether. The aromatic aliphatic diisocyanate is not particularly limited and may be appropriately selected depending on the intended purpose. Examples thereof include $\alpha,\alpha,\alpha',\alpha'$-tetramethylxylene diisocyanate.

The isocyanurate is not particularly limited and may be appropriately selected depending on the intended purpose. Examples thereof include tris(isocyanatoalkyl)isocyanurate, and tris(isocyanatocycloalkyl)isocyanurate.

These polyisocyanates may be used alone or in combination of two or more thereof.

—Curing Agent—

The curing agent is not particularly limited and may be appropriately selected depending on the intended purpose so long as it can react with the prepolymer. Examples thereof include active hydrogen group-containing compounds.

—Active Hydrogen Group-Containing Compound—

An active hydrogen group in the active hydrogen group-containing compound is not particularly limited and may be appropriately selected depending on the intended purpose. Examples thereof include a hydroxyl group (e.g., an alcoholic hydroxyl group, and a phenolic hydroxyl group), an amino group, a carboxyl group, and a mercapto group. These may be used alone or in combination of two or more thereof.

The active hydrogen group-containing compound is not particularly limited and may be appropriately selected depending on the intended purpose, but it is preferably selected from amines, as the amines can form a urea bond.

The amines are not particularly limited and may be appropriately selected depending on the intended purpose. Examples thereof include diamine, trivalent or higher amine, amino alcohol, amino mercaptan, amino acid, and compounds in which the amino groups of the foregoing compounds are blocked. These may be used alone or in combination of two or more thereof.

Among them, diamine, and a mixture of diamine and a small amount of trivalent or higher amine are preferable.

The diamine is not particularly limited and may be appropriately selected depending on the intended purpose. Examples thereof include aromatic diamine, alicyclic diamine, and aliphatic diamine. The aromatic diamine is not particularly limited and may be appropriately selected depending on the intended purpose. Examples thereof include phenylene diamine, diethyl toluene diamine, and 4,4'-diaminodiphenyl methane. The alicyclic diamine is not particularly limited and may be appropriately selected depending on the intended purpose. Examples thereof include 4,4'-diamino-3,3'-dimethyldicyclohexyl methane, diaminocyclohexane, and isophorone diamine. The is aliphatic diamine is not particularly limited and may be appropriately selected depending on the intended purpose. Examples thereof include ethylene diamine, tetramethylene diamine, and hexamethylene diamine.

The trivalent or higher amine is not particularly limited and may be appropriately selected depending on the intended purpose. Examples thereof include diethylene triamine, and triethylene tetramine.

The amino alcohol is not particularly limited and may be appropriately selected depending on the intended purpose. Examples thereof include ethanol amine, and hydroxyethyl aniline.

The aminomercaptan is not particularly limited and may be appropriately selected depending on the intended purpose. Examples thereof include aminoethyl mercaptan, and aminopropyl mercaptan.

The amino acid is not particularly limited and may be appropriately selected depending on the intended purpose. Examples thereof include aminopropionic acid, and aminocaproic acid.

The compound where the amino group is blocked is not particularly limited and may be appropriately selected depending on the intended purpose. Examples thereof include a ketimine compound where the amino group is blocked with ketone such as acetone, methyl ethyl ketone, methyl isobutyl ketone, and an oxazoline compound.

A molecular structure of the polyester resin can be confirmed by solution-state or solid-state NMR, X-ray diffraction, GC/MS, LC/MS, or IR spectroscopy. Simple methods thereof include a method for detecting, as a polyester resin, one that does not have absorption based on δCH (out-of-plane bending vibration) of olefin at 965 $cm^{-1}$±10 $cm^{-1}$ and 990 $cm^{-1}$±10 $cm^{-1}$ in an infrared absorption spectrum.

An amount of the polyester resin is not particularly limited and may be appropriately selected depending on the intended purpose, but it is preferably 50 parts by mass to 90 parts by mass, more preferably 70 parts by mass to 85 parts by mass, relative to 100 parts by mass of the toner. When the amount thereof is smaller than 50 parts by mass, low temperature fixing ability, and hot offset resistance of a resulting toner may be impaired. When the amount thereof is greater than 90 parts by mass, heat resistant storage stability of the toner may be impaired, and glossiness of an image obtained after fixing and coloring ability may reduce. When the amount thereof is within the aforementioned more preferable range, it is advantageous because all of the low temperature fixing ability, hot offset resistance, and heat resistant storage stability excel.

<Crystalline Polyester Resin>

The crystalline polyester resin exhibits thermofusion characteristics in which viscosity is drastically decreases at temperature around fixing onset temperature, as the crystalline polyester resin has crystallinity. By using the crystalline polyester resin having the aforementioned characteristics together with the polyester resin in the toner, the heat resistant storage stability of the toner is excellent up to the melt onset temperature owing to crystallinity, and the toner drastically decreases its viscosity at the melt onset temperature because of melting of the crystalline polyester resin. Along with the drastic decrease in viscosity, the crystalline polyester resin is melt together with the polyester resin, to drastically decrease their viscosity to thereby be fixed. Accordingly, a toner having excellent heat resistant storage stability and low temperature fixing ability can be obtained. Moreover, the toner has excellent results in terms of a releasing width (a difference between the minimum fixing temperature and hot offset occurring temperature).

The crystalline polyester resin is obtained from a polyhydric alcohol and a polyvalent carboxylic acid or a derivative thereof such as a polyvalent carboxylic acid anhydride and a polyvalent carboxylic acid ester.

Note that, in the present invention, the crystalline polyester resin is one obtained from a polyhydric alcohol and a polyvalent carboxylic acid or a derivative thereof such as a polyvalent carboxylic acid anhydride and a polyvalent carboxylic acid ester, as described above, and a resin obtained by modifying a polyester resin, for example, the aforementioned prepolymer and a resin obtained through cross-link and/or chain elongation reaction of the prepolymer do not belong to the crystalline polyester resin.

—Polyhydric Alcohol—

The polyhydric alcohol is not particularly limited and may be appropriately selected depending on the intended purpose. Examples thereof include diol, and trihydric or higher alcohol.

Examples of the diol include saturated aliphatic diol. Examples of the saturated aliphatic diol include linear chain saturated aliphatic diol, and branched-chain saturated aliphatic diol. Among them, linear chain saturated aliphatic diol is preferable, and C2-C12 linear chain saturated aliphatic diol is more preferable. When the saturated aliphatic diol has a branched-chain structure, crystallinity of the crystalline polyester resin C may be low, which may lower the melting point. When the number of carbon atoms in the saturated aliphatic diol is greater than 12, it may be difficult to yield a material in practice. The number of carbon atoms is therefore preferably 12 or less.

Examples of the saturated aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among them, ethylene glycol, 1,4-butanediol, 1,6-hexanediol, 1,8-octanediol, 1,10-decanediol, and 1,12-dodecanediol are preferable, as they give high crystallinity to a resulting crystalline polyester resin, and give excellent sharp melt properties.

Examples of the trihydric or higher alcohol include glycerin, trimethylol ethane, trimethylolpropane, and pentaerythritol. These may be used alone or in combination of two or more thereof.

—Polyvalent Carboxylic Acid—

The polyvalent carboxylic acid is not particularly limited and may be appropriately selected depending on the intended purpose. Examples thereof include divalent carboxylic acid, and trivalent or higher carboxylic acid.

Examples of the divalent carboxylic acid include: saturated aliphatic dicarboxylic acid, such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acid of dibasic acid, such as phthalic acid, isophthalic acid, terephthalic acid, naphthalene-2,6-dicarboxylic acid, malonic acid, and mesaconic acid; and anhydrides of the foregoing compounds, and lower (C1-C3) alkyl ester of the foregoing compounds.

Examples of the trivalent or higher carboxylic acid include 1,2,4-benzenetricarboxylic acid, 1,2,5-benzenetricarboxylic acid, 1,2,4-naphthalene tricarboxylic acid, anhydrides thereof, and lower (C1-C3) alkyl esters thereof.

Moreover, the polyvalent carboxylic acid may contain, other than the saturated aliphatic dicarboxylic acid or aromatic dicarboxylic acid, dicarboxylic acid containing a sulfonic acid group. Further, the polyvalent carboxylic acid may contain, other than the saturated aliphatic dicarboxylic acid or aromatic dicarboxylic acid, dicarboxylic acid having a double bond. These may be used alone or in combination of two or more thereof.

The crystalline polyester resin is preferably composed of a linear chain saturated aliphatic dicarboxylic acid having 4 to 12 carbon atoms and a linear chain saturated aliphatic diol having 2 to 12 carbon atoms. Specifically, the crystalline polyester resin preferably contains a constituent unit derived from a saturated aliphatic dicarboxylic acid having 4 to 12 carbon atoms, and a constituent unit derived from a saturated aliphatic diol having 2 to 12 carbon atoms. As a result of this, crystallinity increases, and sharp melt properties improve, and therefore it is preferable as excellent low temperature fixing ability of the toner is exhibited.

A melting point of the crystalline polyester resin is not particularly limited and may be appropriately selected depending on the intended purpose, but it is preferably 60° C. to 80° C. When the melting point thereof is lower than 60° C., the crystalline polyester resin tends to be melted at low temperature, which may impair heat resistant storage stability of the toner. When the melting point thereof is higher than 80° C., melting of the crystalline polyester resin with heat applied during fixing may be insufficient, which may impair low temperature fixing ability of the toner.

A molecular weight of the crystalline polyester resin is not particularly limited and may be appropriately selected depending on the intended purpose. Since those having a sharp molecular weight distribution and low molecular weight have excellent low temperature fixing ability, and heat resistant storage stability of a resulting toner lowers as an amount of a low molecular weight component, an o-dichlorobenzene soluble component of the crystalline polyester resin preferably has the weight average molecular weight (Mw) of 3,000 to 30,000, number average molecular weight (Mn) of 1,000 to 10,000, and Mw/Mn of 1.0 to 10, as measured by GPC. Further, it is more preferred that the weight average molecular weight (Mw) thereof be 5,000 to 15,000, the number average molecular weight (Mn) there be 2,000 to 10,000, and the Mw/Mn be 1.0 to 5.0.

An acid value of the crystalline polyester resin is not particularly limited and may be appropriately selected depending on the intended purpose, but it is preferably 5 mgKOH/g or higher, more preferably 10 mgKOH/g or higher for achieving the desired low temperature fixing ability in view of affinity between paper and the resin. Meanwhile, the acid value thereof is preferably 45 mgKOH/g or lower for the purpose of improving hot offset resistance.

A hydroxyl value of the crystalline polyester resin is not particularly limited and may be appropriately selected depending on the intended purpose, but it is preferably 0 mgKOH/g to 50 mgKOH/g, more preferably 5 mgKOH/g to 50 mgKOH/g, for achieving the desired low temperature fixing ability and excellent charging properties.

A molecular structure of the crystalline polyester resin can be confirmed by solution-state or solid-state NMR, X-ray diffraction, GC/MS, LC/MS, or IR spectroscopy. Simple methods thereof include a method for detecting, as the crystalline polyester resin, one that has absorption based on δCH (out-of-plane bending vibration) of olefin at 965 $cm^{-1}$±10 $cm^{-1}$ and 990 $cm^{-1}$±10 $cm^{-1}$ in an infrared absorption spectrum.

An amount of the crystalline polyester resin is not particularly limited and may be appropriately selected depending on the intended purpose, but it is preferably 3 parts by mass to 20 parts by mass, more preferably 5 parts by mass to 15 parts by mass, relative to 100 parts by mass of the toner. When the amount thereof is smaller than 3 parts by mass, the crystalline polyester resin does not give sufficient sharp melt properties, which may lead to insufficient low temperature fixing ability of a resulting toner. When the amount thereof is greater than 20 parts by mass, a resulting toner may have low heat resistant storage stability, and tends to cause fogging of an image. When the amount thereof is within the aforementioned more preferable range, it is advantageous because a resulting toner is excellent in terms of both high image quality and low temperature fixing ability.

<Other Components>

Examples of other components include a releasing agent, colorant, charge controlling agent, external additive, a flow improving agent, a cleaning improving agent, and a magnetic material.

—Releasing Agent—

The releasing agent is appropriately selected from those known in the art without any limitation.

Examples of wax serving as the releasing agent include: natural wax, such as vegetable wax (e.g., carnauba wax, cotton wax, Japan wax and rice wax), animal wax (e.g., bees wax and lanolin), mineral wax (e.g., ozokelite and ceresine) and petroleum wax (e.g., paraffin wax, microcrystalline wax and petrolatum).

Examples of the wax other than the above natural wax include synthetic hydrocarbon wax (e.g., Fischer-Tropsch wax and polyethylene wax; and synthetic wax (e.g., ester wax, ketone wax and ether wax).

Further, other examples of the releasing agent include fatty acid amides such as 12-hydroxystearic acid amide, stearic amide, phthalic anhydride imide and chlorinated hydrocarbons; low-molecular-weight crystalline polymers such as acrylic homopolymers (e.g., poly-n-stearyl methacrylate and poly-n-lauryl methacrylate) and acrylic copolymers (e.g., n-stearyl acrylate-ethyl methacrylate copolymers); and crystalline polymers having a long alkyl group as a side chain.

Among them, hydrocarbon wax, such as paraffin wax, microcrystalline wax, Fischer-Tropsch wax, polyethylene wax, and polypropylene wax, is preferable.

A melting point of the releasing agent is not particularly limited and may be appropriately selected depending on the intended purpose, but it is preferably 60° C. to 80° C. When the melting point thereof is lower than 60° C., the releasing agent tends to melt at low temperature, which may impair heat resistant storage stability. When the melting point thereof is higher than 80° C., the releasing agent is not sufficiently melted to thereby cause fixing offset even in the case where the resin is melted and is in the fixing temperature range, which may cause defects in an image.

An amount of the releasing agent is appropriately selected depending on the intended purpose without any limitation, but it is preferably 2 parts by mass to 10 parts by mass, more preferably 3 parts by mass to 8 parts by mass, relative to 100 parts by mass of the toner. When the amount thereof is smaller than 2 parts by mass, a resulting toner may have insufficient hot offset resistance, and low temperature fixing ability during fixing. When the amount thereof is greater than 10 parts by mass, a resulting toner may have insufficient heat resistant storage stability, and tends to cause fogging in an image. When the amount thereof is within the aforementioned more preferable range, it is advantageous because image quality and fixing stability can be improved.

—Colorant—

The colorant is appropriately selected depending on the intended purpose without any limitation, and examples thereof include carbon black, a nigrosin dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmine 6B, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, and lithopone.

An amount of the colorant is not particularly limited and may be appropriately selected depending on the intended purpose, but it is preferably 1 part by mass to 15 parts by mass, more preferably 3 parts by mass to 10 parts by mass, relative to 100 parts by mass of the toner.

The colorant may be used as a master batch in which the colorant forms a composite with a resin. Examples of the binder resin kneaded in the production of, or together with the master batch include, other than the aforementioned crystalline polyester resin, polymer of styrene or substitution thereof (e.g., polystyrene, poly-p-chlorostyrene, and polyvinyl); styrene copolymer (e.g., styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic acid ester copolymer); and others including polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, a terpene resin, an aliphatic or alicyclic hydrocarbon resin, an aromatic petroleum resin, chlorinated paraffin, and paraffin wax. These may be used independently, or in combination.

The master batch can be prepared by mixing and kneading the colorant with the resin for the master batch. In the mixing and kneading, an organic solvent may be used for improving the interactions between the colorant and the resin. Moreover, the master batch can be prepared by a flashing method in which an aqueous paste containing a colorant is mixed and kneaded with a resin and an organic solvent, and then the colorant is transferred to the resin to remove the water and the organic solvent. This method is preferably used because a wet cake of the colorant is used as it is, and it is not necessary to dry the wet cake of the colorant to prepare a colorant. In the mixing and kneading of the colorant and the resin, a high-shearing disperser (e.g., a three-roll mill) is preferably used.

—Charge Controlling Agent—

The charge controlling agent is appropriately selected depending on the intended purpose without any limitation, and examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine active agents, metal salts of salicylic acid, and metal salts of salicylic acid derivatives.

Specific examples thereof include: nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (all manufactured by ORIENT CHEMICAL INDUSTRIES CO., LTD); quaternary ammonium salt molybdenum complex TP-302 and TP-415 (all manufactured by Hodogaya Chemical Co., Ltd.); LRA-901; boron complex LR-147 (manufactured by Japan Carlit Co., Ltd.); copper phthalocyanine; perylene; quinacridone; azo pigments; and polymeric compounds having, as a functional group, a sulfonic acid group, carboxyl group, quaternary ammonium salt, etc.

An amount of the charge controlling agent is not particularly limited and may be appropriately selected depending on the intended purpose, but it is preferably 0.1 parts by mass to 10 parts by mass, more preferably 0.2 parts by mass to 5 parts by mass, relative to 100 parts by mass of the toner. When the amount thereof is greater than 10 parts by mass, the charging ability of the toner becomes excessive, which may reduce the effect of the charge controlling agent, increase electrostatic force to a developing roller, leading to low flowability of the developer, or low image density of the resulting image. These charge controlling agents may be dissolved and dispersed after being melted and kneaded together with the master batch, and/or resin. The charge controlling agents can be, of course, directly added to an organic solvent when dissolution and dispersion is performed. Alternatively, the charge controlling agents may be fixed on surfaces of toner particles after the production of the toner particles.

—External Additive—

As for the external additive, other than oxide particles, a combination of inorganic particles and hydrophobic-treated inorganic particles can be used. The average primary particle diameter of the hydrophobic-treated particles is preferably 1 nm to 100 nm. More preferred are 5 nm to 70 nm of the inorganic particles.

Moreover, it is preferred that the external additive contain at least one type of hydrophobic-treated inorganic particles having the average primary particle diameter of 20 nm or smaller, and at least one type of inorganic particles having the average primary particle diameter of 30 nm or greater. Moreover, the external additive preferably has the BET specific surface area of 20 $m^2/g$ to 500 $m^2/g$.

The external additive is not particularly limited and may be appropriately selected depending on the intended purpose. Examples thereof include silica particles, hydrophobic silica, fatty acid metal salts (e.g., zinc stearate, and aluminum stearate), metal oxide (e.g., titania, alumina, tin oxide, and antimony oxide), and a fluoropolymer.

Examples of the suitable additive include hydrophobic silica, titania, titanium oxide, and alumina particles. Examples of the silica particles include R972, R974, RX200, RY200, R202, R805, and R812 (all manufactured by Nippon Aerosil Co., Ltd.). Examples of the titania particles include P-25 (manufactured by Nippon Aerosil Co., Ltd.); STT-30, STT-65C-S (both manufactured by Titan Kogyo, Ltd.); TAF-140 (manufactured by Fuji Titanium Industry Co., Ltd.); and MT-150W, MT-500B, MT-600B, MT-150A (all manufactured by TAYCA CORPORATION).

Examples of the hydrophobic treated titanium oxide particles include: T-805 (manufactured by Nippon Aerosil Co., Ltd.); STT-30A, STT-65S-S (both manufactured by Titan Kogyo, Ltd.); TAF-500T, TAF-1500T (both manufactured by Fuji Titanium Industry Co., Ltd.); MT-100S, MT-100T (both manufactured by TAYCA CORPORATION); and IT-S (manufactured by ISHIHARA SANGYO KAISHA, LTD.).

The hydrophobic-treated oxide particles, hydrophobic-treated silica particles, hydrophobic-treated titania particles, and hydrophobic-treated alumina particles are obtained, for example, by treating hydrophilic particles with a silane coupling agent, such as methyltrimethoxy silane, methyltriethoxy silane, and octyltrimethoxy silarie. Moreover, silicone oil-treated oxide particles, or silicone oil-treated inorganic particles, which have been treated by adding silicone oil optionally with heat, are also suitably used as the external additive.

Examples of the silicone oil include dimethyl silicone oil, methylphenyl silicone oil, chlorophenyl silicone oil, methyl hydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, methacryl-modified silicone oil, and a-methylstyrene-modified silicone oil.

Examples of the inorganic particles include silica, alumina, titanium oxide, barium titanate, magnesium titanate, calcium titanate, strontium titanate, iron oxide, copper oxide, zinc oxide, tin oxide, quartz sand, clay, mica, wollastonite, diatomaceous earth, chromic oxide, cerium oxide, red iron oxide, antimony trioxide, magnesium oxide, zirconium oxide, barium sulfate, barium carbonate, calcium carbonate, silicon carbide, and silicon nitride. Among them, silica and titanium dioxide are preferable.

An amount of the external additive is not particularly limited and may be appropriately selected depending on the intended purpose, but it is preferably 0.1 parts by mass to 5 parts by mass, more preferably 0.3 parts by mass to 3 parts by mass, relative to 100 parts by mass of the toner.

The average particle diameter of primary particles of the inorganic particles is not particularly limited and may be appropriately selected depending on the intended purpose, but it is preferably 100 nm or smaller, more preferably 3 nm to 70 nm. When it is smaller than the aforementioned range, the inorganic particles are embedded in the toner particles, and therefore the function of the inorganic particles may not be effectively exhibited. When the average particle diameter thereof is greater than the aforementioned range, the inorganic particles may unevenly damage a surface of a photoconductor, and hence not preferable.

—Flowability Improving Agent—

The flowability improving agent is not particularly limited and may be appropriately selected depending on the intended purpose so long as it is capable of performing surface treatment of the toner to increase hydrophobicity, and preventing degradations of flow properties and charging properties of the toner even in a high humidity environment. Examples thereof include a silane-coupling agent, a sililation agent, a silane-coupling agent containing a fluoroalkyl group, an organic titanate-based coupling agent, an aluminum-based coupling agent, silicone oil, and modified silicone oil. It is particularly preferred that the silica or titanium oxide be used as hydrophobic silica or hydrophobic titanium oxide treated with the aforementioned flow improving agent.

—Cleanability Improving Agent—

The cleanability improving agent is not particularly limited and may be appropriately selected depending on the intended purpose so long as it can be added to the toner for the purpose of removing the developer remained on a photoconductor or primary transfer member after transferring. Examples thereof include: fatty acid metal salt such as zinc stearate, calcium stearate, and stearic acid; and polymer particles produced by soap-free emulsion polymerization, such as polymethyl methacrylate particles, and polystyrene particles. The polymer particles are preferably those having a relatively narrow particle size distribution, and the polymer particles having the volume average particle diameter of 0.01 μm to 1 μm are preferably used.

—Magnetic Material—

The magnetic material is not particularly limited and may be appropriately selected depending on the intended purpose. Examples thereof include iron powder, magnetite, and ferrite. Among them, a white magnetic material is preferable in terms of a color tone.

<Glass Transition Temperature (Tg1st)>

The toner has a glass transition temperature (Tg1st) of 20° C. to 50° C., preferably 25° C. to 50° C., where the glass transition temperature (Tg1st) is measured in the first heating in differential scanning calorimetry (DSC) of the toner.

If the Tg of a conventional toner is lowered to be about 50° C. or lower, the conventional toner tends to cause aggregation of toner particles influenced by temperature variations during transportation or storage of the toner in summer or in a tropical region. As a result, adherence of the toner arises in a toner bottle, or within a developing unit. Moreover, supply failures due to clogging of the toner in the toner bottle, and formation of defected images due to toner adherence are likely to occur.

The toner of the present invention has lower Tg than that of a conventional toner. However, the polyester resin, which is a low Tg component in the toner, has a non-linear chain structure, and therefore the toner of the present invention can maintain heat resistant storage stability. Especially in the case where the polyester resin has a urethane bond or urea bond having high cohesive force, an effect of maintaining heat resistant storage stability becomes significant.

A glass transition temperature (Tg2nd) of the toner, where the glass transition temperature (Tg2nd) is measured in the second heating in differential scanning calorimetry (DSC) of the toner, is not particularly limited and may be appropriately selected depending on the intended purpose, but it is preferably 0° C. to 30° C., preferably 10° C. to 30° C.

A difference (Tg1st−Tg2nd) between the glass transition temperature (Tg1st) of the toner as measured in the first heating in differential scanning calorimetry (DSC) and the glass transition temperature (Tg2nd) of the toner as measured in the second heating in DSC is not particularly limited and may be appropriately selected depending on the intended purpose, but it is preferably 0° C. or more (i.e., Tg1st>Tg2nd), more preferably 10° C. or more. The upper limit of the difference is not particularly limited and may be appropriately selected depending on the intended purpose, but the difference (Tg1st−Tg2nd) is preferably 50° C. or less.

When the toner of the present invention contains a crystalline polyester resin, the crystalline polyester resin and the polyester resin, which are present in a non-compatible state before heating (before the first heating), become in a compatible state after heating (after the first heating).

When the Tg1st of the toner is less than 20° C., the toner has poor heat resistant storage stability, causes blocking within a developing unit, and causes filming on a photoconductor. When the Tg1st thereof is more than 50° C., the toner has poor low temperature fixing ability.

When the Tg2nd of the toner is less than 0° C., the fixed image (printed matter) may be degraded in blocking resistance, whereas when it is more than 30° C., sufficient low temperature fixing ability and glossiness cannot be obtained in some cases.

<Volume Average Particle Diameter>

The volume average particle diameter of the toner is not particularly limited and may be appropriately selected depending on the intended purpose, but it is preferably 3 μm to 7 μm. Moreover, a ratio of the volume average particle diameter to the number average particle diameter is preferably 1.2 or less. Further, the toner preferably contains toner particles having the volume average particle diameter of 2 μm or smaller, in an amount of 1% by number to 10% by number.

<Calculation Methods and Analysis Methods of Various Properties of Toner and Constituent Component of Toner>

The Tg, acid value, hydroxyl value, molecular weight, and melting point of the polyester resin, the crystalline polyester resin, and the releasing agent may be each measured. Alternatively, each component may be separated from an actual toner by gel permeation chromatography (GPC) or the like, and separated each component may be subjected to the analysis methods described later, to thereby calculate Tg, molecular weight, melting point, and mass ratio of a constituent component.

Separation of each component by GPC can be performed, for example, by the following method.

In GPC using tetrahydrofuran (THF) as a mobile phase, an eluate is subjected to fractionation by means of a fraction collector, a fraction corresponding to a part of a desired molecular weight is collected from a total area of an elution curve.

The collected eluates are concentrated and dried by an evaporator or the like, and a resulting solid content is dissolved in a deuterated solvent, such as deuterated chloroform, and deuterated THF, followed by measurement of $^{1}$H-NMR. From an integral ratio of each element, a ratio of a constituent monomer of the resin in the elution composition is calculated.

As another method, after concentrating the eluate, hydrolysis is performed with sodium hydroxide or the like, and a ratio of a constituent monomer is calculated by subjecting the decomposed product to a qualitative or quantitative analysis by high performance liquid chromatography (HPLC).

Note that, in the case where the method for producing a toner produces toner base particles by generating the polyester resin through a chain-elongation reaction and/or crosslink reaction of the non-linear chain reactive precursor and the curing agent, the polyester resin may be separated froth an actual toner by GPC or the like, to thereby determine Tg thereof. Alternatively, a polyester resin is separately generated through a chain-elongation reaction and/or crosslink reaction of the non-linear chain reactive precursor and the curing agent, and Tg may be measured on the synthesized polyester resin.

<<Separation Unit for Toner Constituent Components>>

An example of a separation unit for each component during an analysis of the toner will be specifically explained hereinafter.

First, 1 g of a toner is added to 100 mL THF, and the resulting mixture is stirred for 30 minutes at 25° C., to thereby a solution in which soluble components are dissolved.

The solution is then filtered through a membrane filter having an opening of 0.2 μm, to thereby obtain the THF soluble components in the toner.

Next, the THF soluble components are dissolved in THF, to thereby prepare a sample for measurement of GPC, and the prepared sample is supplied to GPC used for molecular weight measurement of each resin mentioned above.

Meanwhile, a fraction collector is disposed at an eluate outlet of GPC, to fraction the eluate per a certain count. The eluate is obtained per 5% in terms of the area ratio from the elution onset on the elution curve (raise of the curve).

Next, each eluted fraction, as a sample, in an amount of 30 mg is dissolved in 1 mL of deuterated chloroform, and to this solution, 0.05% by volume of tetramethyl silane (TMS) is added as a standard material.

A glass tube for NMR having a diameter of 5 mm is charged with the solution, from which a spectrum is obtained by means of a nuclear magnetic resonance apparatus (JNM-AL 400, manufactured by JEOL Ltd.) by performing multiplication 128 times at temperature of 23° C. to 25° C.

The monomer compositions and the compositional ratios of the polyester resin, the crystalline polyester resin, and the like contained in the toner are determined from peak integral ratios of the obtained spectrum.

For example, an assignment of a peak is performed in the following manner, and a constituent monomer component ratio is determined from each integral ratio.

The assignment of a peak is as follows:

Around 8.25 ppm: derived from a benzene ring of trimellitic acid (for one hydrogen atom)

Around the region of 8.07 ppm to 8.10 ppm: derived from a benzene ring of terephthalic acid (for four hydrogen atoms)

Around the region of 7.1 ppm to 7.25 ppm: derived from a benzene ring of bisphenol A (for four hydrogen atoms)

Around 6.8 ppm: derived from a benzene ring of bisphenol A (for four hydrogen atoms), and derived from a double bond of fumaric acid (for two hydrogen atoms)

Around the region of 5.2 ppm to 5.4 ppm: derived from methine of bisphenol A propylene oxide adduct (for one hydrogen atom)

Around the region of 4.0 ppm to 5.0 ppm: derived from methylene of an aliphatic alcohol (for two hydrogen atoms)

Around the region of 3.7 ppm to 4.7 ppm: derived from methylene of a bisphenol A propylene oxide adduct (for two hydrogen atoms), and derived from methylene of a bisphenol A ethylene oxide (for four hydrogen atoms)

Around the region of 2.2 ppm to 2.6 ppm: derived from methylene of an aliphatic carboxylic acid (for two hydrogen atoms)

Around 1.6 ppm: derived from a methyl group of bisphenol A and an aliphatic alcohol (for 6 hydrogen atoms).

From these results, for example, the extracted product collected in the fraction in which the polyester resin occupies 90% or more in the peak integral ratio in the spectrum can be treated as the polyester resin.

Similarly, the extracted product collected in the fraction in which the crystalline polyester resin occupies 90% or more in the peak integral ratio in the spectrum can be treated as the crystalline polyester resin.

<<Measurement Methods of Melting Point and Glass Transition Temperature (Tg)>>

In the present invention, a melting point and a glass transition temperature (Tg) can be measured, for example, by means of a differential scanning calorimeter (DSC) system (Q-200, manufactured by TA Instruments Japan Inc.).

Specifically, a melting point and glass transition temperature of a sample are measured in the following manners.

Specifically, first, an aluminum sample container charged with about 5.0 mg of a sample is placed on a holder unit, and the holder unit is then set in an electric furnace. Next, the sample is heated (first heating) from −80° C. to 150° C. at the heating rate of 10° C./min in a nitrogen atmosphere. Then, the sample is cooled from 150° C. to −80° C. at the cooling rate of 10° C./min, followed by again heating (second heating) to 150° C. at the heating rate of 10° C./min. DSC curves are respectively measured for the first heating and the second heating by means of a differential scanning calorimeter (Q-200, manufactured by TA Instruments Japan Inc.).

The DSC curve for the first heating is selected from the obtained DSC curve by means of an analysis program stored in the Q-200 system, to thereby determine glass transition temperature of the sample with the first heating. Similarly, the DSC curve for the second heating is selected, and the glass transition temperature of the sample with the second heating can be determined.

Moreover, the DSC curve for the first heating is selected from the obtained DSC curve by means of the analysis program stored in the Q-200 system, and an endothermic peak top temperature of the sample for the first heating is determined as a melting point of the sample. Similarly, the DSC curve for the second heating is selected, and the endothermic peak top temperature of the sample for the second heating can be determined as a melting point of the sample with the second heating.

In the case where a toner is used as a sample, glass transition temperature for the first heating is represented as Tg1st, and glass transition temperature for the second heating is represented as Tg2nd in the present specification.

Moreover, in the present specification, the endothermic peak top temperatures and glass transition temperatures of the polyester resin, the crystalline polyester resin, and other constituent components, such as the releasing agent, for the second heating are regarded as melting point and Tg of each sample, unless otherwise stated.

<Production Method of Toner>

A production method of the toner is not particularly limited and may be appropriately selected depending on the intended purpose, but the toner is preferably granulated by dispersing, in an aqueous medium, an oil phase containing the polyester resin, preferably further containing the crystalline polyester resin, and if necessary, further containing the releasing agent and the colorant.

Also, the toner is more preferably granulated by dispersing, in an aqueous medium, an oil phase containing: as the polyester resin, a polyester resin which is a prepolymer containing a urethane bond, a urea bond, or both; and a polyester resin not containing a urethane bond, a urea bond, or both; preferably further containing the crystalline polyester resin; and if necessary, further containing the curing agent, the releasing agent, the colorant, etc.

As one example of such a production method of the toner, a conventionally dissolution suspension method is listed. As one example of the production method of the toner, a method for forming toner base particles while extending the polyester resin through a chain-elongation reaction and/or cross-link reaction between the prepolymer and the curing agent will be described hereinafter. In such a method, a preparation of an aqueous medium, preparation of an oil phase containing a toner material, emulsification and/or dispersion of the toner material, and removal of an organic solvent are carried out.

—Preparation of Aqueous Medium (Aqueous Phase)—

The preparation of the aqueous phase can be carried out, for example, by dispersing resin particles in an aqueous medium. An amount of the resin particles in the aqueous medium is not particularly limited and may be appropriately selected depending on the intended purpose, but it is preferably 0.5 parts by mass to 10 parts by mass relative to 100 parts by mass of the aqueous medium.

The aqueous medium is not particularly limited and may be appropriately selected depending on the intended purpose. Examples thereof include water, a solvent miscible with water, and a mixture thereof. These may be used independently, or in combination. Among them, water is preferable.

The solvent miscible with water is not particularly limited and may be appropriately selected depending on the intended purpose. Examples thereof include alcohol, dimethyl formamide, tetrahydrofuran, cellosolve, and lower ketone. The alcohol is not particularly limited and may be appropriately selected depending on the intended purpose. Examples thereof include methanol, isopropanol, and ethylene glycol. The lower ketone is not particularly limited and may be appropriately selected depending on the intended purpose. Examples thereof include acetone and methyl ethyl ketone.

—Preparation of Oil Phase—

The oil phase containing the toner materials can be prepared by dissolving or dispersing, in an organic solvent, toner materials containing: at least a polyester resin which is a prepolymer containing a urethane bond, a urea bond, or both; a polyester resin not containing a urethane bond, a urea bond, or both; and the crystalline polyester resin, and if necessary, further containing the curing agent, the releasing agent, the colorant, etc.

The organic solvent is not particularly limited and may be appropriately selected depending on the intended purpose, but it is preferably an organic solvent having a boiling point of lower than 150° C., as removal thereof is easy.

The organic solvent having the boiling point of lower than 150° C. is not particularly limited and may be appropriately selected depending on the intended purpose. Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These may be used alone or in combination of two or more thereof.

Among them, ethyl acetate, toluene, xylene, benzene, methylene chloride, 1,2-dichloroethane, chloroform, and carbon tetrachloride are particularly preferable, and ethyl acetate is more preferable.

—Emulsification or Dispersion—

The emulsification or dispersion of the toner materials can be carried out by dispersing the oil phase containing the toner materials in the aqueous medium. In the course of the emulsification or dispersion of the toner material, the curing agent and the prepolymer are allowed to carry out a chain-elongation reaction or cross-link reaction.

The reaction conditions (e.g., the reaction time and reaction temperature) for generating the prepolymer are not particularly limited and may be appropriately selected depending on a combination of the curing agent and the prepolymer.

The reaction time is not particularly limited and may be appropriately selected depending on the intended purpose, but it is preferably 10 minutes to 40 hours, more preferably 2 hours to 24 hours.

The reaction temperature is not particularly limited and may be appropriately selected depending on the intended purpose, but it is preferably 0° C. to 150° C., more preferably 40° C. to 98° C.

A method for stably forming a dispersion liquid containing the prepolymer in the aqueous medium is not particularly limited and may be appropriately selected depending on the intended purpose. Examples thereof include a method in which an oil phase, which has been prepared by dissolving and/or dispersing a toner material in a solvent, is added to a phase of an aqueous medium, followed by dispersing with shear force.

A disperser used for the dispersing is not particularly limited and may be appropriately selected depending on the intended purpose. Examples thereof include a low-speed shearing disperser, a high-speed shearing disperser, a friction disperser, a high-pressure jetting disperser and an ultrasonic wave disperser.

Among them, the high-speed shearing disperser is preferable, because it can control the particle diameters of the dispersed elements (oil droplets) to the range of 2 μm to 20 μm.

In the case where the high-speed shearing disperser is used, the conditions for dispersing, such as the rotating speed, dispersion time, and dispersion temperature, may be appropriately selected depending on the intended purpose.

The rotational speed is not particularly limited and may be appropriately selected depending on the intended purpose, but it is preferably 1,000 rpm to 30,000 rpm, more preferably 5,000 rpm to 20,000 rpm.

The dispersion time is not particularly limited and may be appropriately selected depending on the intended purpose, but it is preferably 0.1 minutes to 5 minutes in case of a batch system.

The dispersion temperature is not particularly limited and may be appropriately selected depending on the intended purpose, but it is preferably 0° C. to 150° C., more preferably 40° C. to 98° C. under pressure. Note that, generally speaking, dispersion can be easily carried out, as the dispersion temperature is higher.

An amount of the aqueous medium used for the emulsification or dispersion of the toner material is not particularly limited and may be appropriately selected depending on the intended purpose, but it is preferably 50 parts by mass to 2,000 parts by mass, more preferably 100 parts by mass to 1,000 parts by mass, relative to 100 parts by mass of the toner material.

When the amount of the aqueous medium is smaller than 50 parts by mass, the dispersion state of the toner material is impaired, which may result a failure in attaining toner base particles having desired particle diameters. When the amount thereof is greater than 2,000 parts by mass, the production cost may increase.

When the oil phase containing the toner material is emulsified or dispersed, a dispersant is preferably used for the purpose of stabilizing dispersed elements, such as oil droplets, and gives a shape particle size distribution as well as giving desirable shapes of toner particles.

The dispersant is not particularly limited and may be appropriately selected depending on the intended purpose. Examples thereof include a surfactant, a water-insoluble inorganic compound dispersant, and a polymer protective colloid. These may be used alone or in combination of two or more thereof. Among them, the surfactant is preferable.

The surfactant is not particularly limited and may be appropriately selected depending on the intended purpose.

Examples thereof include an anionic surfactant, a cationic surfactant, a nonionic surfactant, and an amphoteric surfactant.

The anionic surfactant is not particularly limited and may be appropriately selected depending on the intended purpose. Examples thereof include alkyl benzene sulfonic acid salts, α-olefin sulfonic acid salts and phosphoric acid esters. Among them, those having a fluoroalkyl group are preferable.

—Removal of Organic Solvent—

A method for removing the organic solvent from the dispersion liquid such as the emulsified slurry is not particularly limited and may be appropriately selected depending on the intended purpose. Examples thereof include: a method in which an entire reaction system is gradually heated to evaporate out the organic solvent in the oil droplets; and a method in which the dispersion liquid is sprayed in a dry atmosphere to remove the organic solvent in the oil droplets.

As the organic solvent removed, toner base particles are formed. The toner base particles can be subjected to washing and drying, and can be further subjected to classification. The classification may be carried out in a liquid by removing small particles by cyclone, a decanter, or centrifugal separator, or may be performed on particles after drying.

The obtained toner base particles may be mixed with particles such as the external additive, and the charge controlling agent. By applying a mechanical impact during the mixing, the particles such as the external additive can be prevented from fall off from surfaces of the toner base particles.

A method for applying the mechanical impact is not particularly limited and may be appropriately selected depending on the intended purpose. Examples thereof include: a method for applying impulse force to a mixture by a blade rotating at high speed; a method for adding a mixture into a high-speed air flow and accelerating the speed of the flow to thereby make the particles crash into other particles, or make the composite particles crush into an appropriate impact board.

A device used for this method is appropriately selected depending on the intended purpose without any limitation, and examples thereof include ANGMILL (product of Hosokawa Micron Corporation), an apparatus produced by modifying I-type mill (product of Nippon Pneumatic Mfg. Co., Ltd.) to reduce the pulverizing air pressure, a hybridization system (product of Nara Machinery Co., Ltd.), a kryptron system (product of Kawasaki Heavy Industries, Ltd.) and an automatic mortar.

(Developer)

A developer of the present invention contains at least the toner, and may further contain appropriately selected other components, such as carrier, if necessary.

Accordingly, the developer has excellent transfer properties, and charging ability, and can stably form high quality images. Note that, the developer may be a one-component developer, or a two-component developer, but it is preferably a two-component developer when it is used in a high speed printer corresponding to recent high information processing speed, because the service life thereof can be improved.

In the case where the developer is used as a one-component developer, the diameters of the toner particles do not vary largely even when the toner is supplied and consumed repeatedly, the toner does not cause filming to a developing roller, nor fuse to a layer thickness regulating member such as a blade for thinning a thickness of a layer of the toner, and provides excellent and stable developing ability and image even when it is stirred in the developing device over a long period of time.

In the case where the developer is used as a two-component developer, the diameters of the toner particles in the developer do not vary largely even when the toner is supplied and consumed repeatedly, and the toner can provide excellent and stabile developing ability even when the toner is stirred in the developing device over a long period of time.

<Carrier>

The carrier is appropriately selected depending on the intended purpose without any limitation, but it is preferably a carrier containing a core, and a resin layer covering the core.

—Core—

A material of the core is appropriately selected depending on the intended purpose without any limitation, and examples thereof include a 50 emu/g to 90 emu/g manganese-strontium (Mn—Sr) material, and a 50 emu/g to 90 emu/g manganese-magnesium (Mn—Mg) material. To secure a sufficient image density, use of a hard magnetic material such as iron powder (100 emu/g or higher), and magnetite (75 emu/g to 120 emu/g) is preferable. Moreover, use of a soft magnetic material such as a 30 emu/g to 80 emu/g copper-zinc material is preferable because an impact applied to a photoconductor by the developer born on a bearing member in the form of a brush can be reduced, which is an advantageous for improving image quality.

These may be used alone or in combination of two or more thereof.

The volume average particle diameter of the core is not particularly limited and may be appropriately selected depending on the intended purpose, but it is preferably 10 μm to 150 μm, more preferably 40 μm to 100 μm. When the volume average particle diameter thereof is smaller than 10 μm, the proportion of fine particles in the distribution of carrier particle diameters increases, causing carrier scattering because of low magnetization per carrier particle. When the volume average particle diameter thereof is greater than 150 μm, the specific surface area reduces, which may cause toner scattering, causing reproducibility especially in a solid image portion in a full color printing containing many solid image portions.

In the case where the toner is used for a two-component developer, the toner is used by mixing with the carrier. An amount of the carrier in the two-component developer is not particularly limited and may be appropriately selected depending on the intended purpose, but it is preferably 90 parts by mass to 98 parts by mass, more preferably 93 parts by mass to 97 parts by mass, relative to 100 parts by mass of the two-component developer.

The developer of the present invention may be suitably used in image formation by various known electrophotographies such as a magnetic one-component developing method, a non-magnetic one-component developing method, and a two-component developing method.

(Developer Accommodating Container)

A developer accommodating container of the present invention accommodates the developer of the present invention. The container thereof is not particularly limited and may be appropriately selected from known containers. Examples thereof include those having a cap and a container main body.

The size, shape, structure and material of the container main body are not particularly limited. The container main body preferably has, for example, a hollow-cylindrical shape. Particularly preferably, it is a hollow-cylindrical body whose inner surface has spirally-arranged concavo-convex portions some or all of which can accordion and in which the developer accommodated can be transferred to an outlet port through rotation. The material for the developer-accommodating container is not particularly limited and is preferably those from which the container main body can be formed with high dimensional accuracy. Examples thereof include polyester resins, polyethylene resins, polypropylene resins, polystyrene resins, polyvinyl chloride resins, polyacrylic acids, polycarbonate resins, ABS resins and polyacetal resins.

The above developer accommodating container has excellent handleability; i.e., is suitable for storage, transportation, and is suitably used for supply of the developer with being detachably mounted to, for example, the below-described process cartridge and image forming apparatus.

(Image Forming Apparatus and Image Forming Method)

An image forming apparatus of the present invention includes at least an electrostatic latent image bearing member, an electrostatic latent image forming unit, and a developing unit, and if necessary, further includes other units.

An image forming method of the present invention includes at least an electrostatic latent image forming step and a developing step, and if necessary, further includes other steps.

The image forming method can suitably be performed by the image forming apparatus, the electrostatic latent image forming step can suitably be performed by the electrostatic latent image forming unit, the developing step can suitably be performed by the developing unit, and the other steps can suitably be performed by the other units.

<Electrostatic Latent Image Bearing Member>

The material, structure, and size of the electrostatic latent image bearing member are not particularly limited and may be appropriately selected from those known in the art. Regarding the material, the electrostatic latent image bearing member is, for example, an inorganic photoconductor made of amorphous silicon or selenium, or an organic photoconductor made of polysilane or phthalopolymethine. Among them, an amorphous silicon photoconductor is preferred since it has a long service life.

The amorphous silicon photoconductor may be, for example, a photoconductor having a support and an electrically photoconductive layer of a-Si, which is formed on the support heated to 50° C. to 400° C. with a film forming method such as vacuum vapor deposition, sputtering, ion plating, thermal CVD (Chemical Vapor Deposition), photo-CVD or plasma CVD. Among them, plasma CVD is suitably employed, in which gaseous raw materials are decomposed through application of direct current or high-frequency or microwave glow discharge to form an a-Si deposition film on the support.

The shape of the electrostatic latent image bearing member is not particularly limited and may be appropriately selected depending on the intended purpose, but it is preferably a hollow-cylindrical shape. The outer diameter of the electrostatic latent image bearing member having a hollow-cylindrical shape is not particularly limited and may be appropriately selected depending on the intended purpose, but it is preferably 3 mm to 100 mm, more preferably 5 mm to 50 mm, particularly preferably 10 mm to 30 mm.

<Electrostatic Latent Image Forming Unit and Electrostatic Latent Image Forming Step>

The electrostatic latent image forming unit is not particularly limited and may be appropriately selected depending on the intended purpose so long as it is a unit configured to form an electrostatic latent image on the electrostatic latent image bearing member. Examples thereof include a unit including at least a charging member configured to charge a surface of the electrostatic latent image bearing member and an exposing member configured to imagewise expose the surface of the electrostatic latent image bearing member to light.

The electrostatic latent image forming step is not particularly limited and may be appropriately selected depending on the intended purpose so long as it is a step of forming an electrostatic latent image on the electrostatic latent image bearing member. The electrostatic latent image forming step can be performed using the electrostatic latent image forming unit by, for example, charging a surface of the electrostatic latent image bearing member and then imagewise exposing the surface thereof to light.

—Charging Member and Charging—

The charging member is not particularly limited and may be appropriately selected depending on the intended purpose. Examples thereof include contact-type charging devices known per se having, for example, an electrically conductive or semiconductive roller, brush, film and rubber blade; and non-contact-type charging devices utilizing corona discharge such as corotron and scorotron.

The charging can be performed by, for example, applying voltage to the surface of the electrostatic latent image bearing member using the charging member.

The charging member may have any shape like a charging roller as well as a magnetic brush or a fur brush. The shape thereof may be suitably selected according to the specification or configuration of the image forming apparatus.

The charging member is not limited to the aforementioned contact-type charging members. However, the contact-type charging members are preferably used from the viewpoint of producing an image forming apparatus in which the amount of ozone generated from the charging members is reduced.

—Exposing Member and Exposure—

The exposing member is not particularly limited and may be appropriately selected depending on the purpose so long as it attains desired imagewise exposure on the surface of the electrophotographic latent image bearing member charged with the charging member. Examples thereof include various exposing members such as a copy optical exposing device, a rod lens array exposing device, a laser optical exposing device, and a liquid crystal shutter exposing device.

A light source used for the exposing member is not particularly limited and may be appropriately selected depending on the intended purpose. Examples thereof include conventional light-emitting devices such as a fluorescent lamp, a tungsten lamp, a halogen lamp, a mercury lamp, a sodium lamp, a light-emitting diode (LED), a laser diode (LD) and an electroluminescence (EL) device.

Also, various filters may be used for emitting only light having a desired wavelength range. Examples of the filters include a sharp-cut filter, a band-pass filter, an infrared cut filter, a dichroic filter, an interference filter and a color temperature conversion filter.

The exposure can be performed by, for example, imagewise exposing the surface of the electrostatic latent image bearing member to light using the exposing member.

In the present invention, light may be imagewise applied from the side facing the support of the electrostatic latent image bearing member.

<Developing Unit and Developing Step>

The developing unit is not particularly limited and may be appropriately selected depending on the intended purpose so long as it is a developing unit containing a toner for developing the electrostatic latent image formed on the electrostatic latent image bearing member to thereby form a visible image.

The developing step is not particularly limited and may be appropriately selected depending on the intended purpose so long as it is a step of developing the electrostatic latent image formed on the electrostatic latent image bearing member with a toner, to thereby form a visible image. The developing step can be performed by the developing unit.

The developing unit may employ a dry or wet developing process, and may be a single-color or multi-color developing unit.

The developing unit is preferably a developing device containing: a stirring device for charging the toner with friction generated during stirring; a magnetic field-generating unit fixed inside; and a developer bearing member configured to bear a developer containing the toner on a surface thereof and to be rotatable.

In the developing unit, toner particles and carrier particles are stirred and mixed so that the toner particles are charged by friction generated therebetween. The charged toner particles are retained in the chain-like form on the surface of the rotating magnetic roller to form magnetic brushes. The magnetic roller is disposed proximately to the electrostatic latent image developing member and thus, some of the toner particles forming the magnetic brushes on the magnet roller are transferred onto the surface of the electrostatic latent image developing member by the action of electrically attractive force. As a result, the electrostatic latent image is developed with the toner particles to form a visual toner image on the surface of the electrostatic latent image developing member.

<Other Units and Other Steps>

Examples of the other units include a transfer unit, a fixing unit, a cleaning unit, a charge-eliminating unit, a recycling unit, and a controlling unit.

Examples of the other step include a transfer step, a fixing step, a cleaning step, a charge-eliminating step, a recycling step, and a controlling step.

—Transfer Unit and Transfer Step—

The transfer unit is not particularly limited and may be appropriately selected depending on the intended purpose so long as it is a unit configured to transfer the visible image onto a recording medium. Preferably, the transfer unit includes: a primary transfer unit configured to transfer the visible images to an intermediate transfer member to form a composite transfer image; and a secondary transfer unit configured to transfer the composite transfer image onto a recording medium.

The transfer step is not particularly limited and may be appropriately selected depending on the intended purpose so long as it is a step of transferring the visible image onto a recording medium. In this step, preferably, the visible images are primarily transferred to an intermediate transfer member, and the thus-transferred visible images are secondarily transferred to the recording medium.

For example, the transfer step can be performed using the transfer unit by charging the photoconductor with a transfer charger to transfer the visible image.

Here, when the image to be secondarily transferred onto the recording medium is a color image of several color toners, a configuration can be employed in which the transfer unit sequentially superposes the color toners on top of another on the intermediate transfer member to form an image on the intermediate transfer member, and the image on the intermediate transfer member is secondarily transferred at one time onto the recording medium by the intermediate transfer unit.

The intermediate transfer member is not particularly limited and may be appropriately selected from known transfer members depending on the intended purpose. For example, the intermediate transfer member is preferably a transferring belt.

The transfer unit (including the primary- and secondary transfer units) preferably includes at least a transfer device which transfers the visible images from the photoconductor onto the recording medium. Examples of the transfer device include a corona transfer device employing corona discharge, a transfer belt, a transfer roller, a pressing transfer roller and an adhesive transferring device.

The recording medium is not particularly limited and may be appropriately selected depending on the purpose, so long as it can receive a developed, unfixed image. Examples of the recording medium include plain paper and a PET base for OHP, with plain paper being used typically.

—Fixing Unit and Fixing Step—

The fixing unit is not particularly limited and may be appropriately selected depending on the intended purpose as long as it is a unit configured to fix a transferred image which has been transferred on the recording medium, but is preferably known heating-pressurizing members. Examples thereof include a combination of a heat roller and a press roller, and a combination of a heat roller, a press roller and an endless belt.

The fixing step is not particularly restricted and may be appropriately selected according to purpose, as long as it is a step of fixing a visible image which has been transferred on the recording medium. The fixing step may be performed every time when an image of each color toner is transferred onto the recording medium, or at one time (at the same time) on a laminated image of color toners.

The fixing step can be performed by the fixing unit.

The heating-pressurizing member usually performs heating preferably at 80° C. to 200° C.

Notably, in the present invention, known photofixing devices may be used instead of or in addition to the fixing unit depending on the intended purpose.

A surface pressure at the fixing step is not particularly limited and may be appropriately selected depending on the intended purpose, but is preferably 10 $N/cm^2$ to 80 $N/cm^2$.

—Cleaning Unit and Cleaning Step—

The cleaning unit is not particularly limited and may be appropriately selected depending on the intended purpose, as long as it can remove the toner remaining on the photoconductor. Examples thereof include a magnetic brush cleaner, an electrostatic brush cleaner, a magnetic roller cleaner, a blade cleaner, a brush cleaner and a web cleaner.

The cleaning step is not particularly limited and may be appropriately selected depending on the intended purpose, as long as it is a step of removing the toner remaining on the photoconductor. It may be performed by the cleaning unit.

—Charge-Eliminating Unit and Charge-Eliminating Step—

The charge-eliminating unit is not particularly limited and may be appropriately selected depending on the intended purpose, as long as it is a unit configured to apply a charge-eliminating bias to the photoconductor to thereby charge-eliminate. Examples thereof include a charge-eliminating lamp.

The charge-eliminating step is not particularly limited and may be appropriately selected depending on the intended purpose, as long as it is a step of applying a charge-eliminating bias to the photoconductor to thereby charge-eliminate. It may be carried out by the charge-eliminating unit.

—Recycling Unit and Recycling Step—

The recycling unit is not particularly limited and may be appropriately selected depending on the intended purpose, as long as it is a unit configured to recycle the toner which has been removed at the cleaning step to the developing device. Example thereof includes a known conveying unit.

The recycling step is not particularly limited and may be appropriately selected depending on the intended purpose, as long as it is a step of recycling the toner which has been removed at the cleaning step to the developing device. The recycling step can be performed by the recycling unit.

—Control Unit and Control Step—

The control unit is not particularly limited and may be appropriately selected depending on the intended purpose, as long as it can control the operation of each of the above units. Examples thereof include devices such as sequencer and computer.

The control step is not particularly limited and may be appropriately selected depending on the intended purpose, as long as it is a step of controlling the operation of each of the above units. The control step can be performed by the control unit.

One embodiment for performing an image forming method by an image forming apparatus of the present invention now will be explained with reference to FIG. 1. An image forming apparatus 100A illustrated in FIG. 1 includes a photoconductor drum 10 serving as the electrostatic latent image bearing member (hereinafter may be referred to as a "photoconductor 10"), a charging roller 20 serving as the charging unit, an exposing device 30 serving as the exposing unit, a developing device 40 serving as the developing unit, an intermediate transfer member 50, a cleaning device 60 serving as the cleaning unit which includes a cleaning blade and a charge-eliminating lamp 70 serving as the charge-eliminating unit.

The intermediate transfer member 50 is an endless belt and designed so as to be movable in a direction indicated by an arrow by three rollers 51 which are disposed inside the belt and around which the belt is stretched. A part of the three rollers 51 also functions as a transfer bias roller which may apply a predetermined transfer bias (primary transfer bias) to the intermediate transfer member 50. Also, a cleaning device 90 including a cleaning blade is disposed near the intermediate transfer member 50. Further, a transfer roller 80 serving as the transfer unit which can apply a transfer bias for transferring (secondary transferring) a developed image (toner image) onto transfer paper 95 serving as a recording medium is disposed near the intermediate transfer member 50 facing the intermediate transfer member 50. In addition, around the intermediate transfer member 50, a corona charging device 58 for applying a charge to the toner image transferred on the intermediate transfer member 50 is disposed between a contact portion of the electrostatic latent image bearing member 10 with the intermediate transfer member 50 and a contact portion of the intermediate transfer member 50 with the transfer paper 95 in a rotational direction of the intermediate transfer member 50.

The developing device 40 includes a developing belt 41 serving as the developer bearing member; and a black developing unit 45K, a yellow developing unit 45Y, a magenta developing unit 45M and a cyan developing unit 45C which are arranged around the developing belt 41. Here, the black developing unit 45K includes a developer container 42K, a developer supply roller 43K and a developing roller 44K. The yellow developing unit 45Y includes a developer container 42Y, a developer supply roller 43Y and a developing roller 44Y. The magenta developing unit 45M includes a developer container 42M, a developer supply roller 43M and a developing roller 44M. The cyan developing unit 45C includes a developer container 42C, a developer supply roller 43C and a developing roller 44C. Also, the developing belt 41 is an endless belt which is rotatably stretched around a plurality of belt rollers and is partially in contact with the electrostatic latent image bearing member 10.

In the color image forming apparatus 100 illustrated in FIG. 1, the charging roller 20 uniformly charges a surface of the photoconductor drum 10, and then the exposing device 30 imagewise-exposes the photoconductor drum 10 to form an electrostatic latent image. Next, the electrostatic latent image formed on the photoconductor drum 10 is developed with a toner supplied from the developing device 40 to form a toner image. Further, the toner image is transferred (primarily transferred) onto the intermediate transfer member 50 by voltage applied from the roller 51 and then transferred (secondarily transferred) onto transfer paper 95. As a result, a transferred image is formed on the transfer paper 95. Notably, a residual toner remaining on the photoconductor drum 10 is removed by the cleaning device 60, and the photoconductor drum 10 is once charge-eliminated by the charge-eliminating lamp 70.

Figure 2:
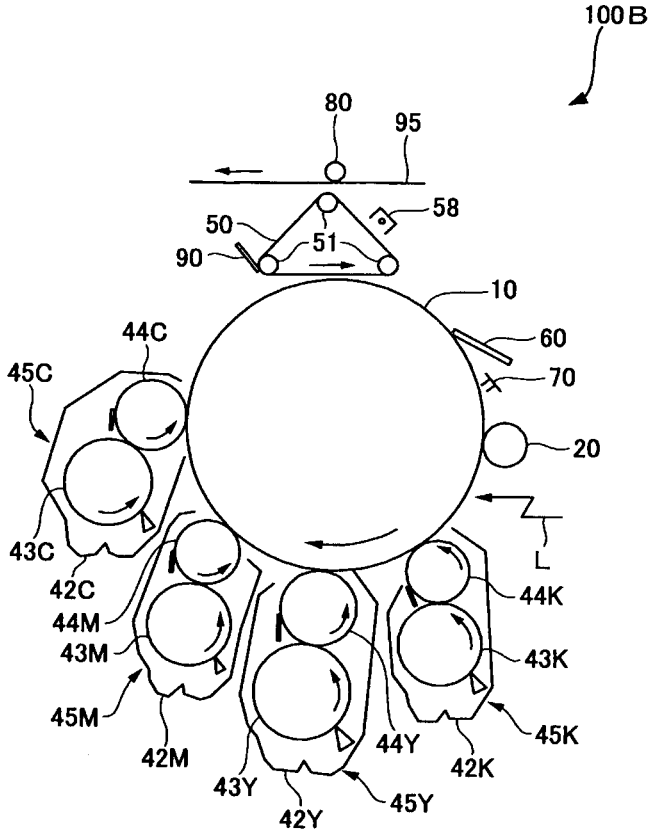
FIG. 2 is a schematic structural view of another example of an image forming apparatus of the present invention.

FIG. 2 is a schematic structural view of another example of an image forming apparatus of the present invention. An image forming apparatus 100B has the same configuration as the image forming apparatus 100A illustrated in FIG. 1 except that the developing belt 41 is not included and that, around the photoconductor drum 10, the black developing unit 45K, the yellow developing unit 45Y, the magenta developing unit 45M and the cyan developing unit 45C are disposed facing directly to the electrostatic latent image bearing member.

Figure 3:
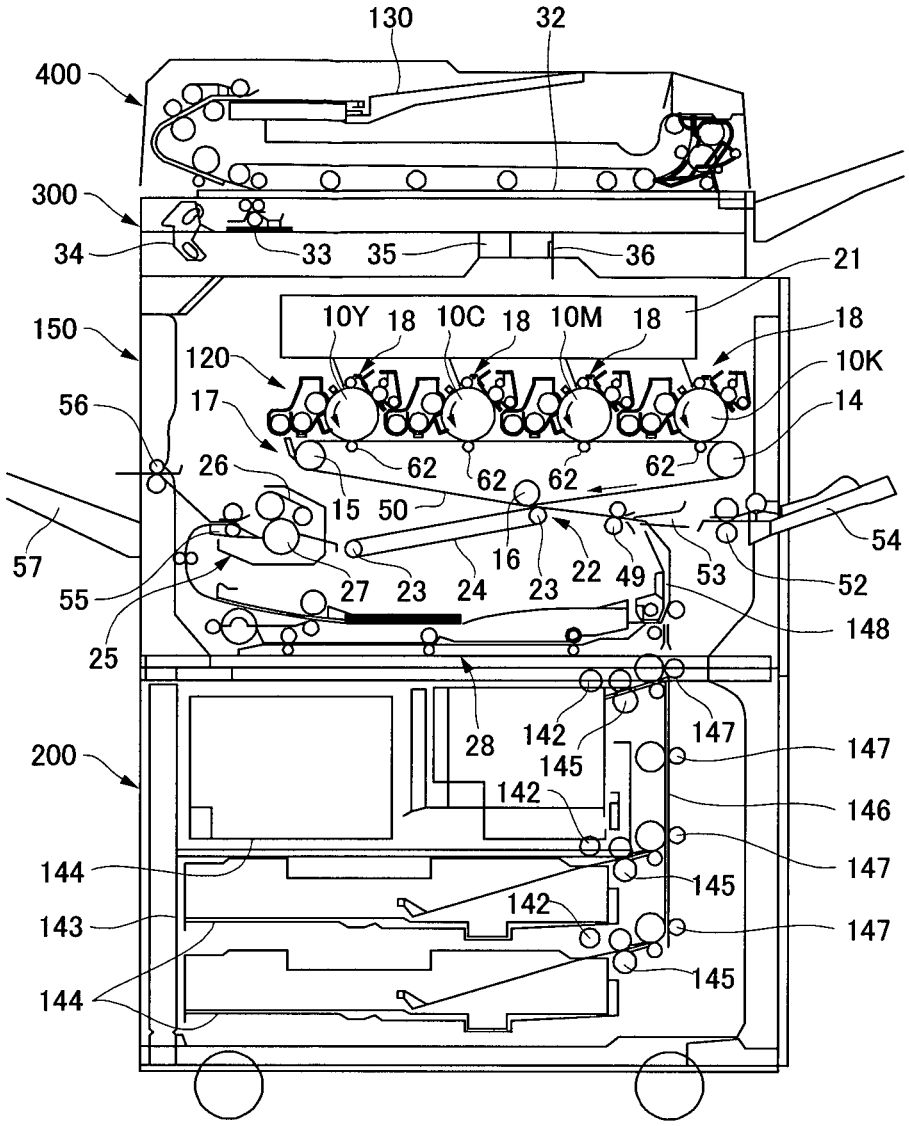
FIG. 3 is a schematic structural view of still another example of an image forming apparatus of the present invention.

FIG. 3 is a schematic structural view of still another example of an image forming apparatus of the present invention. The color image forming apparatus illustrated in FIG. 2 includes a copying device main body 150, a paper feeding table 200, a scanner 300 and an automatic document feeder (ADF) 400.

An intermediate transfer member 50 which is an endless belt is disposed at a central part of the copying device main body 150. The intermediate transfer member 50 is stretched around support rollers 14, 15 and 16 and can rotate in a clockwise direction in FIG. 3. Near the support roller 15, a cleaning device for the intermediate transfer member 17 is disposed to remove a residual toner remaining on the intermediate transfer member 50. On the intermediate transfer member 50 stretched around the support rollers 14 and 15, a tandem type developing device 120 is disposed in which four image forming units 18 of yellow, cyan, magenta and black are arranged in parallel so as to face to each other along a conveying direction thereof. The exposing device 21 serving as the exposing member is disposed in proximity to the tandem type developing device 120. Further, a secondary transfer device 22 is disposed on a side of the intermediate transfer member 50 opposite to the side on which the tandem type developing device 120 is disposed. In the secondary transfer device 22, the secondary transfer belt 24 which is an endless belt is stretched around a pair of rollers 23, and the transfer paper conveyed on the secondary transfer belt 24 and the intermediate transfer member 50 may contact with each other. Here, a fixing device 25 serving as the fixing unit is disposed in proximity to the secondary transfer device 22.

The fixing device 25 includes a fixing belt 26 which is an endless belt and a press roller 27 which is disposed so as to be pressed against the fixing belt.

Here, in the tandem type image forming apparatus, a sheet inverting device 28 is disposed near the secondary transfer device 22 and the fixing device 25 for inverting the transfer paper in the case of forming images on both sides of the transfer paper.

Next, a method for forming a full-color image (color-copying) using the tandem type developing device 120 will be explained. First, a color document is set on a document table 130 of the automatic document feeder (ADF) 400. Alternatively, the automatic document feeder 400 is opened, the color document is set on a contact glass 32 of the scanner 300, and the automatic document feeder 400 is closed.

When a start button (not shown) is pressed, the scanner 300 activates after the color document is conveyed and moved to the contact glass 32 in the case the color document has been set on the automatic document feeder 400, or right away in the case the color document has been set on the contact glass 32, so that a first travelling body 33 and a second travelling body 34 travel. At this time, a light is irradiated from a light source in the first travelling body 33, the light reflected from a surface of the document is reflected by a mirror in the second travelling body 34 and then is received by a reading sensor 36 through an imaging lens 35. Thus, the color document (color image) is read to thereby form black, yellow, magenta and cyan image information.

Figure 4:
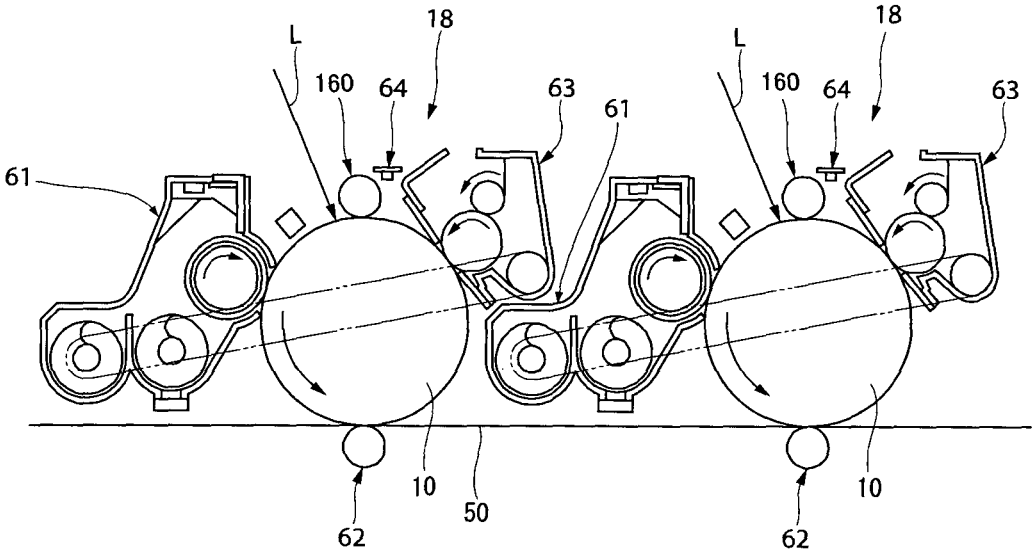
FIG. 4 is a partially enlarged view of FIG. 3.

The image information of black, yellow, magenta, and cyan are transmitted to the image forming units 18 (black image forming unit, yellow image forming unit, magenta image forming unit, and cyan image forming unit) in the tandem type developing device 120, and toner images of black, yellow, magenta, and cyan are formed in the image forming units. As illustrated in FIG. 4, the image forming units 18 (black image forming unit, yellow image forming unit, magenta image forming unit, and cyan image forming unit) in the tandem type developing device 120 include: electrostatic latent image bearing members 10 (black electrostatic latent image bearing member 10K, yellow electrostatic latent image bearing member 10Y, magenta electrostatic latent image bearing member 10M, and cyan electrostatic latent image bearing member 10C); a charging device 160 configured to uniformly charge the electrostatic latent image bearing members 10; an exposing device configured to imagewise-expose to a light (L illustrated in FIG. 4) the electrostatic latent image bearing members based on color image informations to form an electrostatic latent image corresponding to color images on the electrostatic latent image bearing members; a developing device 61 configured to develop the electrostatic latent images with color toners (black color toner, yellow color toner, magenta color toner, and cyan color toner) to form a toner image of the color toners; a transfer charger 62 configured to transfer the toner image onto the intermediate transfer member 50; a cleaning device 63; and a charge-eliminating unit 64. Each image forming unit 18 can form monochrome images (black image, yellow image, magenta image, and cyan image) based on image formations of colors. Thus formed black image (i.e., black image formed onto the black electrostatic latent image bearing member 10K), yellow image (i.e., yellow image formed onto the yellow electrostatic latent image bearing member 10Y), magenta image (i.e., magenta image formed onto the magenta electrostatic latent image bearing member 10M), and cyan image (i.e., cyan image formed onto the cyan electrostatic latent image bearing member 10C) are sequentially transferred (primarily transferred) onto the intermediate transfer member 50 which is rotatably moved by the support rollers 14, 15 and 16. The black image, the yellow image, the magenta image, and the cyan image are superposed on the intermediate transfer member 50 to thereby form a composite color image (color transfer image).

Meanwhile, on the paper feeding table 200, one of paper feeding rollers 142 is selectively rotated to feed a sheet (recording paper) from one of the paper feeding cassettes 144 equipped in multiple stages in a paper bank 143. The sheet is separated one by one by a separation roller 145 and sent to a paper feeding path 146. The sheet (recording paper) is conveyed by a conveying roller 147 and is guided to a paper feeding path 148 in the copying device main body 150, and stops by colliding with a registration roller 49. Alternatively, a paper feeding roller 142 is rotated to feed a sheet (recording paper) on a manual feed tray 54. The sheet (recording paper) is separated one by one by a separation roller 52 and is guided to a manual paper feeding path 53, and stops by colliding with the registration roller 49. Notably, the registration roller 49 is generally used while grounded, but it may also be used in a state that a bias is being applied for removing paper dust on the sheet. Next, by rotating the registration roller 49 in accordance with the timing of the composite toner image (color transferred image) formed on the intermediate transfer member 50, the sheet (recording paper) is fed to between the intermediate transfer member 50 and the secondary transfer device 22. Thereby, the composite toner image (color transferred image) is transferred (secondarily transferred) by the secondary transfer device 22 onto the sheet (recording paper) to thereby form a color image on the sheet (recording paper). Notably, a residual toner remaining on the intermediate transfer member 50 after image transfer is removed by the cleaning device for the intermediate transfer member 17.

The sheet (recording paper) on which the color image has been transferred is conveyed by the secondary transfer device 22, and then conveyed to the fixing device 25. In the fixing device 25, the composite color image (color transferred image) is fixed on the sheet (recording paper) by the action of heat and pressure. Next, the sheet (recording paper) is switched by a switching claw 55, and discharged by a discharge roller 56 and stacked in a paper discharge tray 57. Alternatively, the sheet is switched by the switching claw 55, and is inverted by the inverting device 28 to thereby be guided to a transfer position again. After an image is formed similarly on the rear surface, the recording paper is discharged by the discharge roller 56 stacked in the paper discharge tray 57.

(Process Cartridge)

A process cartridge of the present invention is molded so as to be mounted to various image forming apparatuses in an attachable and detachable manner, including at least an electrostatic latent image bearing member configured to bear an electrostatic latent image thereon; and a developing unit configured to develop the electrostatic latent image borne on the electrostatic latent image bearing member with the developer of the present invention to form a toner image. Note that, the process cartridge of the present invention may further include other units, if necessary.

The developing unit includes at least a developer accommodating container that accommodates the developer of the present invention, and a developer bearing member configured to bear and transfer the developer accommodated in the developer accommodating container. Note that, the developing unit may further include, for example, a regulating member configured to regulate the thickness of the borne developer.

Figure 5:
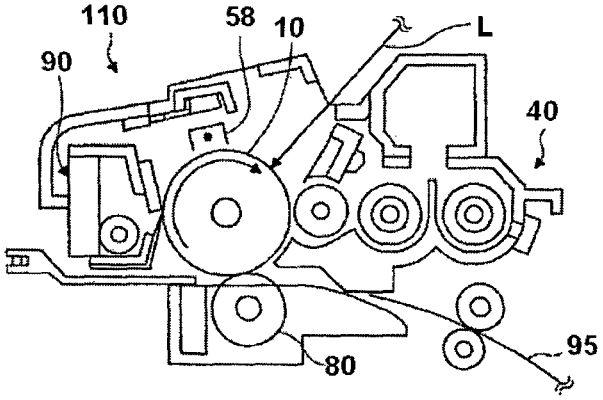
FIG. 5 is a schematic structural view of one example of a process cartridge.

FIG. 5 illustrates one example of the process cartridge of the present invention. A process cartridge 110 includes a photoconductor drum 10, a corona charging device 52, a developing device 40, a transfer roller 80, and a cleaning device 90.

EXAMPLES

The present invention will be described by way of Examples below. The present invention should not be construed as being limited to the Examples. Unless otherwise specified, "part(s)" means "part(s) by mass". Unless otherwise specified, "%" means "% by mass".

Measurements in the Examples below were obtained by the methods described in the present specification.

Production Example A-1

<Synthesis of Non-Crystalline Polyester Resin A1>

A reaction vessel equipped with a condenser, a stirrer, and a nitrogen-inducing tube was charged with terephthalic acid (26.5 parts), an ethylene oxide 2.2 mol adduct of bisphenol A (13.5 parts), a propylene oxide 2.2 mol adduct of bisphenol A (59.9 parts), and dibutyltinoxide (0.2 parts). The mixture was allowed to react under normal pressure at 230° C. for 4 hours, and then was allowed to react for 5 hours at a reduced pressure of 10 mmHg to 15 mmHg, to thereby obtain noncrystalline polyester resin A1.

Production Example A-2

<Synthesis of Non-Crystalline Polyester Resin A2>

A reaction vessel equipped with a condenser, a stirrer, and a nitrogen-inducing tube was charged with isophthalic acid (22.4 parts), an ethylene oxide 2.2 mol adduct of bisphenol A (56.9 parts), a propylene oxide 2.2 mol adduct of bisphenol A (15.8 parts), and dibutyltinoxide (0.2 parts). The mixture was allowed to react under normal pressure at 230° C. for 4 hours, and then was allowed to react for 5 hours at a reduced pressure of 10 mmHg to 15 mmHg, to thereby obtain non-crystalline polyester resin A2.

Production Example A-3

<Synthesis of Non-Crystalline Polyester Resin A3>

A reaction vessel equipped with a condenser, a stirrer, and a nitrogen-inducing tube was charged with terephthalic acid (16.5 parts), adipic acid (21.7 parts), an ethylene oxide 2.2 mol adduct of bisphenol A (38.7 parts), 3-methyl-1,5-pentanediol (21.1 parts), and dibutyltinoxide (0.2 parts). The mixture was allowed to react under normal pressure at 230° C. for 4 hours, and then was allowed to react for 5 hours at a reduced pressure of 10 mmHg to 15 mmHg, to thereby obtain non-crystalline polyester resin A1.

Production Example A-4

<Synthesis of Non-Crystalline Polyester Resin A4>

A reaction vessel equipped with a condenser, a stirrer, and a nitrogen-inducing tube was charged with terephthalic acid (25.8 parts), adipic acid (27.8 parts), 3-methyl-1,5-pentanediol (44.9 parts), trimethylolpropane (1.5 parts), and dibutyltinoxide (0.2 parts). The mixture was allowed to react under normal pressure at 230° C. for 4 hours, and then was allowed to react for 5 hours at a reduced pressure of 10 mmHg to 15 mmHg, to thereby obtain an intermediate of non-crystalline polyester resin A4.

Next, a reaction container equipped with a condenser, a stirrer, and a nitrogen-inducing tube was charged with the intermediate of non-crystalline polyester resin A4 (90 parts) and isophorone diisocyanate (IPDI) (10 parts). The mixture was diluted with ethyl acetate (100 parts) and was allowed to react at 80° C. for 5 hours, to thereby obtain [ethyl acetate solution of the non-crystalline polyester resin A4] which is a prepolymer.

Production Examples A-5 to A-17

<Synthesis of Non-Crystalline Polyester Resins A5 to A17>

In the same manner as in Production Example A-4 except that the kind and amount of each of the monomers were changed to those shown in Tables 1-1 and 1-2, ethyl acetate solutions of non-crystalline polyester resins A5 to A17 which are prepolymers were obtained.

The kinds and amounts of each monomer are shown in Tables 1-1 and 1-2. The units of these amounts are "parts by mass".

Tables 1-3 and 1-4 show a molar ratio (%) of each of the dicarboxylic acids in the dicarboxylic acid component and a molar ratio (%) of each of the diols in the diol component.

Table 2 shows compositional ratios of raw materials for the ethyl acetate solutions of the non-crystalline polyester resins A4 to A6 and A8 to A17. The units of the ratios are parts by mass.

TABLE 1-1

| | Non-crystalline polyester resins | | | | | | | |
|---|---|---|---|---|---|---|---|---|
| | A1 | A2 | A3 | A4 intermediate | A5 intermediate | A6 intermediate | A7 | A8 intermediate |
| Terephthalic acid | 26.5 | 0.0 | 16.5 | 25.8 | 25.8 | 25.5 | 26.1 | 27.3 |
| Isophthalic acid | 0.0 | 22.4 | 0.0 | 0.0 | 0.0 | 0.0 | 0.0 | 0.0 |
| Adipic acid | 0.0 | 4.9 | 21.7 | 27.8 | 27.8 | 27.4 | 28.1 | 29.3 |
| Ethylene oxide 2.2 mol adduct of bisphenol A | 13.5 | 56.9 | 38.7 | 0.0 | 0.0 | 0.0 | 0.0 | 0.0 |
| Propylene oxide 2.2 mol adduct of bisphenol A | 59.9 | 15.8 | 0.0 | 0.0 | 0.0 | 0.0 | 0.0 | 0.0 |
| Ethylene glycol | 0.0 | 0.0 | 0.0 | 0.0 | 0.0 | 0.0 | 0.0 | 0.0 |
| Propylene glycol | 0.0 | 0.0 | 0.0 | 0.0 | 0.0 | 0.0 | 0.0 | 0.0 |
| 1,4-Butanediol | 0.0 | 0.0 | 0.0 | 0.0 | 0.0 | 0.0 | 0.0 | 0.0 |

TABLE 1-1-continued

| | Non-crystalline polyester resins | | | | | | | |
|---|---|---|---|---|---|---|---|---|
| | A1 | A2 | A3 | A4 intermediate | A5 intermediate | A6 intermediate | A7 | A8 intermediate |
| 1,5-Pentanediol | 0.0 | 0.0 | 0.0 | 0.0 | 0.0 | 0.0 | 0.0 | 41.8 |
| 2-Methyl-1,3-propanediol | 0.0 | 0.0 | 0.0 | 0.0 | 0.0 | 0.0 | 0.0 | 0.0 |
| 3-Methyl-1,5-pentanediol | 0.0 | 0.0 | 21.1 | 44.9 | 44.9 | 44.3 | 43.3 | 0.0 |
| 1,12-Dodecanediol | 0.0 | 0.0 | 0.0 | 0.0 | 0.0 | 0.0 | 0.0 | 0.0 |
| Trimethylol-propane | 0.0 | 0.0 | 2.0 | 1.5 | 0.0 | 0.0 | 2.5 | 1.6 |
| Pentaerythritol | 0.0 | 0.0 | 0.0 | 0.0 | 1.6 | 0.0 | 0.0 | 0.0 |
| Dipentaerythritol | 0.0 | 0.0 | 0.0 | 0.0 | 0.0 | 2.9 | 0.0 | 0.0 |
| Trimellitic acid | 0.0 | 0.0 | 0.0 | 0.0 | 0.0 | 0.0 | 0.0 | 0.0 |
| Dibutyltinoxide | 0.2 | 0.2 | 0.2 | 0.2 | 0.2 | 0.2 | 0.2 | 0.2 |

TABLE 1-2

| | Non-crystalline polyester resins | | | | | | | | |
|---|---|---|---|---|---|---|---|---|---|
| | A9 int.* | A10 int. | A11 int. | A12 int. | A13 int. | A14 int. | A15 int. | A16 int. | A17 int. |
| Terephthalic acid | 28.9 | 28.9 | 34.1 | 39.5 | 25.6 | 26.2 | 19.6 | 32.8 | 65.3 |
| Isophthalic acid | 0.0 | 0.0 | 0.0 | 0.0 | 0.0 | 0.0 | 0.0 | 0.0 | 0.0 |
| Adipic acid | 31.1 | 31.1 | 20.0 | 14.9 | 27.5 | 28.2 | 21.0 | 35.3 | 0.0 |
| Ethylene oxide 2.2 mol adduct of bisphenol A | 0.0 | 0.0 | 0.0 | 0.0 | 0.0 | 0.0 | 0.0 | 0.0 | 0.0 |
| Propylene oxide 2.2 mol adduct of bisphenol A | 0.0 | 0.0 | 0.0 | 0.0 | 0.0 | 0.0 | 0.0 | 0.0 | 0.0 |
| Ethylene glycol | 0.0 | 0.0 | 0.0 | 0.0 | 0.0 | 0.0 | 0.0 | 30.0 | 0.0 |
| Propylene glycol | 0.0 | 0.0 | 0.0 | 0.0 | 0.0 | 0.0 | 0.0 | 0.0 | 32.9 |
| 1,4-Butane-diol | 38.3 | 0.0 | 0.0 | 0.0 | 0.0 | 0.0 | 0.0 | 0.0 | 0.0 |
| 1,5-Pentane-diol | 0.0 | 0.0 | 0.0 | 0.0 | 0.0 | 0.0 | 0.0 | 0.0 | 0.0 |
| 2-Methyl-1,3-propane-diol | 0.0 | 38.3 | 0.0 | 0.0 | 0.0 | 0.0 | 0.0 | 0.0 | 0.0 |
| 3-Methyl-1,5-pentane-diol | 0.0 | 0.0 | 44.4 | 44.1 | 44.5 | 45.6 | 0.0 | 0.0 | 0.0 |
| 1,12-Dodecane-diol | 0.0 | 0.0 | 0.0 | 0.0 | 0.0 | 0.0 | 58.2 | 0.0 | 0.0 |
| Trimethylol-propane | 1.7 | 1.7 | 1.5 | 1.5 | 0.0 | 0.0 | 1.2 | 1.9 | 1.7 |
| Penta erythritol | 0.0 | 0.0 | 0.0 | 0.0 | 0.0 | 0.0 | 0.0 | 0.0 | 0.0 |
| Dipenta-erythritol | 0.0 | 0.0 | 0.0 | 0.0 | 0.0 | 0.0 | 0.0 | 0.0 | 0.0 |
| Trimellitic acid | 0.0 | 0.0 | 0.0 | 0.0 | 2.4 | 0.0 | 0.0 | 0.0 | 0.0 |
| Dibutyl-tinoxide | 0.2 | 0.2 | 0.2 | 0.2 | 0.2 | 0.2 | 0.2 | 0.2 | 0.2 |

*In Table 1-2, "int." means "intermediate".

TABLE 1-3

| | | Non-crystalline polyester resins | | | | | | | |
|---|---|---|---|---|---|---|---|---|---|
| | | A1 | A2 | A3 | A4 | A5 | A6 | A7 | A8 |
| Dicarboxylic acid | Terephthalic acid | 100 | 0 | 40 | 45 | 45 | 45 | 45 | 45 |
| | Isophthalic acid | 0 | 80 | 0 | 0 | 0 | 0 | 0 | 0 |
| | Adipic acid | 0 | 20 | 60 | 55 | 55 | 55 | 55 | 55 |
| Diol | Ethylene oxide 2.2 mol adduct of bisphenol A | 20 | 80 | 40 | 0 | 0 | 0 | 0 | 0 |
| | Propylene oxide 2.2 mol adduct of bisphenol A | 80 | 20 | 0 | 0 | 0 | 0 | 0 | 0 |
| | Ethylene glycol | 0 | 0 | 0 | 0 | 0 | 0 | 0 | 0 |
| | Propylene glycol | 0 | 0 | 0 | 0 | 0 | 0 | 0 | 0 |
| | 1,4-Butane-diol | 0 | 0 | 0 | 0 | 0 | 0 | 0 | 0 |
| | 1,5-Pentane-diol | 0 | 0 | 0 | 0 | 0 | 0 | 0 | 100 |
| | 2-Methyl-1,3-propane-diol | 0 | 0 | 0 | 0 | 0 | 0 | 0 | 0 |
| | 3-Methyl-1,5-pentane-diol | 0 | 0 | 60 | 100 | 100 | 100 | 100 | 0 |
| | 1,12-Dodecane-diol | 0 | 0 | 0 | 0 | 0 | 0 | 0 | 0 |

TABLE 1-4

| | | Non-crystalline polyester resins | | | | | | | | |
|---|---|---|---|---|---|---|---|---|---|---|
| | | A9 | A10 | A11 | A12 | A13 | A14 | A15 | A16 | A17 |
| Dicarboxylic acid | Terephthalic acid | 45 | 45 | 60 | 70 | 45 | 45 | 45 | 45 | 100 |
| | Isophthalic acid | 0 | 0 | 0 | 0 | 0 | 0 | 0 | 0 | 0 |
| | Adipic acid | 55 | 55 | 40 | 30 | 55 | 55 | 55 | 55 | 0 |
| Diol | Ethylene oxide 2.2 mol adduct of bisphenol A | 0 | 0 | 0 | 0 | 0 | 0 | 0 | 0 | 0 |
| | Propylene oxide 2.2 mol adduct of bisphenol A | 0 | 0 | 0 | 0 | 0 | 0 | 0 | 0 | 0 |
| | Ethylene glycol | 0 | 0 | 0 | 0 | 0 | 0 | 0 | 100 | 0 |
| | Propylene glycol | 0 | 0 | 0 | 0 | 0 | 0 | 0 | 0 | 100 |
| | 1,4-Butane-diol | 100 | 0 | 0 | 0 | 0 | 0 | 0 | 0 | 0 |
| | 1,5-Pentane-diol | 0 | 0 | 0 | 0 | 0 | 0 | 0 | 0 | 0 |
| | 2-Methyl-1,3-propane-diol | 0 | 100 | 0 | 0 | 0 | 0 | 0 | 0 | 0 |
| | 3-Methyl-1,5-pentane-diol | 0 | 0 | 100 | 100 | 100 | 100 | 0 | 0 | 0 |
| | 1,12-Dodecane-diol | 0 | 0 | 0 | 0 | 0 | 0 | 100 | 0 | 0 |

TABLE 2

| | Non-crystalline polyester resins (prepolymers) | | | | | | | | | | | | |
|---|---|---|---|---|---|---|---|---|---|---|---|---|---|
| | A4 | A5 | A6 | A8 | A9 | A10 | A11 | A12 | A13 | A14 | A15 | A16 | A17 |
| A4 int.* | 90 | 0 | 0 | 0 | 0 | 0 | 0 | 0 | 0 | 0 | 0 | 0 | 0 |
| A5 int. | 0 | 90 | 0 | 0 | 0 | 0 | 0 | 0 | 0 | 0 | 0 | 0 | 0 |
| A6 int. | 0 | 0 | 90 | 0 | 0 | 0 | 0 | 0 | 0 | 0 | 0 | 0 | 0 |
| A8 int. | 0 | 0 | 0 | 90 | 0 | 0 | 0 | 0 | 0 | 0 | 0 | 0 | 0 |
| A9 int. | 0 | 0 | 0 | 0 | 90 | 0 | 0 | 0 | 0 | 0 | 0 | 0 | 0 |
| A10 int. | 0 | 0 | 0 | 0 | 0 | 90 | 0 | 0 | 0 | 0 | 0 | 0 | 0 |
| A11 int. | 0 | 0 | 0 | 0 | 0 | 0 | 90 | 0 | 0 | 0 | 0 | 0 | 0 |
| A12 int. | 0 | 0 | 0 | 0 | 0 | 0 | 0 | 90 | 0 | 0 | 0 | 0 | 0 |
| A13 int. | 0 | 0 | 0 | 0 | 0 | 0 | 0 | 0 | 90 | 0 | 0 | 0 | 0 |

TABLE 2-continued

| | Non-crystalline polyester resins (prepolymers) | | | | | | | | | | | | |
|---|---|---|---|---|---|---|---|---|---|---|---|---|---|
| | A4 | A5 | A6 | A8 | A9 | A10 | A11 | A12 | A13 | A14 | A15 | A16 | A17 |
| A14 int. | 0 | 0 | 0 | 0 | 0 | 0 | 0 | 0 | 0 | 90 | 0 | 0 | 0 |
| A15 int. | 0 | 0 | 0 | 0 | 0 | 0 | 0 | 0 | 0 | 0 | 90 | 0 | 0 |
| A16 int. | 0 | 0 | 0 | 0 | 0 | 0 | 0 | 0 | 0 | 0 | 0 | 90 | 0 |
| A17 int. | 0 | 0 | 0 | 0 | 0 | 0 | 0 | 0 | 0 | 0 | 0 | 0 | 90 |
| IPDI | 10 | 10 | 10 | 10 | 10 | 10 | 10 | 10 | 10 | 10 | 10 | 10 | 10 |
| Ethyl acetate | 100 | 100 | 100 | 100 | 100 | 100 | 100 | 100 | 100 | 100 | 100 | 100 | 100 |

*In Table 2, "int." means "intermediate".

<Synthesis of Crystalline Polyester Resin B>

A 5 L four necked flask equipped with a nitrogen-introducing tube, a drainpipe, a stirrer and a thermocouple was charged with dodecanedioic acid and 1,6-hexanediol so that the molar ratio of hydroxyl groups to carboxyl groups, represented by OH/COOH, was 0.9. The resultant mixture was allowed to react with titanium tetraisopropoxide (500 ppm relative to the resin component) for 10 hours at 180° C. The reaction mixture was heated to 200° C. and reacted for 3 hours, followed by further reacting for 2 hours at a pressure of 8.3 kPa, to thereby obtain crystalline polyester resin B.

Example 1

<Preparation of Master Batch (MB)>

Water (1,200 parts), 500 parts of carbon black (Printex 35, manufactured by Evonik Degussa Japan Co., Ltd.) [DBP oil absorption amount=42 mL/100 mg, pH=9.5], and 500 parts of the non-crystalline polyester resin A1 were added and mixed together by means of HENSCHEL MIXER (manufactured by NIPPON COLE & ENGINEERING CO., LTD.), and the resulting mixture was kneaded by means of a two roll mill for 30 minutes at 150° C. The resulting kneaded product was rolled out and cooled, followed by pulverizing by a pulverizer, to thereby obtain master batch 1.

<Preparation of WAX Dispersion Liquid>

A vessel to which a stirring bar and a thermometer had been set was charged with 50 parts of paraffin wax (HNP-9, manufactured by Nippon Seiro Co., Ltd., hydrocarbon wax, melting point: 75° C., SP value: 8.8) as a releasing agent, and 450 parts of ethyl acetate, followed by heating to 80° C. with mixing. The temperature was maintained at 80° C. for 5 hours, followed by cooling to 30° C. over 1 hour. The resulting mixture was dispersed by means of a bead mill (ULTRA VISCOMILL, product of AIMEX CO., Ltd.) under the conditions: a liquid feed rate of 1 kg/hr, disc circumferential velocity of 6 m/s, 0.5 mm-zirconia beads packed to 80% by volume, and 3 passes, to thereby obtain [WAX dispersion liquid].

<Preparation of Crystalline Polyester Resin Dispersion Liquid>

A container equipped with a stirring bar and a thermometer was charged with 50 parts of the crystalline polyester resin B, and 450 parts of ethyl acetate, and the resulting mixture was heated to 80° C. with stirring. The temperature was kept at 80° C. for 5 hours, followed by cooling to 30° C. over 1 hour. The resultant was dispersed by means of a bead mill (ULTRA VISCOMILL, manufactured by AIMEX CO., LTD.), under the following conditions: a liquid feed rate of 1 kg/hr, disc circumferential velocity of 6 m/s, zirconia beads 0.5 mm in diameter packed to 80% by volume, and 3 passes, to thereby obtain [crystalline polyester resin dispersion liquid].

<Preparation of Oil Phase>

A vessel was charged with 500 parts of the [WAX dispersion liquid], 300 parts of the [ethyl acetate solution of non-crystalline polyester resin A4], 500 parts of the [crystalline polyester resin dispersion liquid], 700 parts of the [non-crystalline polyester resin A1], 100 parts of the [master batch 1], and 2 parts of isophorone diamine as a curing agent. The resultant mixture was mixed by means of a TK Homomixer (manufactured by PRIMIX Corporation) at 5,000 rpm for 60 minutes, to thereby obtain [oil phase].

<Synthesis of Organic Particle Emulsion (Particle Dispersion Liquid)>

A reaction vessel equipped with a stirring bar and a thermometer was charged with 683 parts of water, 11 parts of a sodium salt of sulfuric acid ester of methacrylic acid-ethylene oxide adduct (ELEMINOL RS-30, manufactured by Sanyo Chemical Industries, Ltd.), 138 parts of styrene, 138 parts of methacrylic acid, and 1 part of ammonium persulfate, and the resulting mixture was stirred for 15 minutes at 400 rpm, to thereby obtain a white emulsion. The obtained emulsion was heated to have the system temperature of 75° C., and was then allowed to react for 5 hours. To the resultant, 30 parts of a 1% ammonium persulfate aqueous solution was added, followed by aging for 5 hours at 75° C., to thereby obtain an aqueous dispersion liquid of a vinyl resin (a copolymer of styrene/methacrylic acid/sodium salt of sulfuric acid ester of methacrylic acid ethylene oxide adduct), i.e., [particle dispersion liquid].

The [particle dispersion liquid] was measured by means of LA-920 (manufactured by HORIBA, Ltd.), and as a result, the volume average particle diameter thereof was found to be 0.14 μm. Part of the [particle dispersion liquid] was dried, and a resin component thereof was isolated.

<Preparation of Aqueous Phase>

Water (990 parts), 83 parts of the [particle dispersion liquid], 37 parts of a 48.5% aqueous solution of sodium dodecyldiphenyl ether disulfonate (ELEMINOL MON-7, manufactured by Sanyo Chemical Industries Ltd.), and 90 parts of ethyl acetate were mixed and stirred, to thereby obtain an opaque white liquid. The obtained liquid was used as [aqueous phase].

<Emulsification and Removal of Solvent>

To a container charged with the [oil phase], 1,200 parts of the [aqueous phase] was added, and the resulting mixture was mixed by means of a TK Homomixer at 13,000 rpm for 20 minutes, to thereby obtain [emulsified slurry].

A container equipped with a stirrer and a thermometer was charged with the [emulsified slurry], followed by removing the solvent therein at 30° C. for 8 hours. There-after, the resultant was matured at 45° C. for 4 hours, to thereby obtain [dispersion slurry].

<Washing and Drying>

After subjecting 100 parts of the [dispersion slurry] to filtration under the reduced pressure, the resultant was subjected twice to a series of treatments (1) to (4) described below, to thereby produce [filtration cake]:

(1): ion-exchanged water (100 parts) was added to the filtration cake, followed by mixing with TK Homomixer (at 12,000 rpm for 10 minutes) and then filtration;

(2): 10% aqueous sodium hydroxide solution (100 parts) was added to the filtration cake obtained in (1), followed by mixing with TK Homomixer (at 12,000 rpm for 30 minutes) and then filtration under reduced pressure;

(3): 10% by mass hydrochloric acid (100 parts) was added to the filtration cake obtained in (2), followed by mixing with TK Homomixer (at 12,000 rpm for 10 minutes) and then filtration; and (4): ion-exchanged water (300 parts) was added to the filtration cake obtained in (3), followed by mixing with TK Homomixer (at 12,000 rpm for 10 minutes) and then filtration.

The [filtration cake] was dried with an air-circulating drier at 45° C. for 48 hours, and then was caused to pass through a sieve with a mesh size of 75 μm, to thereby prepare [toner base particles 1].

The toner base particles 1 (100 parts by mass), hydrophobic silica having an average particle diameter of 100 nm (0.6 parts by mass), titanium oxide having an average particle diameter of 20 nm (1.0 part by mass), and hydrophobic silica fine powder having an average particle diameter of 15 nm (0.8 parts by mass) were mixed together in a Henschel mixer to thereby obtain toner 1.

<Production of Carrier>

To 100 parts by mass of toluene, 100 parts by mass of a silicone resin (organo straight silicone), 5 parts by mass of γ-(2-aminoethyl)aminopropyltrimethoxy silane, and 10 parts by mass of carbon black were added, and the resultant mixture was dispersed by means of a homomixer for 20 minutes, to thereby prepare a resin layer coating liquid. To surfaces of spherical magnetite particles having the average particle diameter of 50 μm (1,000 parts by mass), the resin layer coating liquid was applied by means of a fluidized bed coating device, to thereby prepare a carrier.

<Production of Developer>

By means of a ball mill, 5 parts by mass of the toner and 95 parts by mass of the carrier were mixed, to thereby produce a developer. Next, each of the produced developers was evaluated for various properties in the following manner.

The following evaluations were performed. The results are shown in Table 4.

<Offset Resistance>

Each of the developers was charged into a unit of IMAGIO MP C4300 (product of Ricoh Company, Ltd.) and a rectangular solid image of 2 cm×15 cm was formed on PPC paper sheets (Type 6000 <70W> A4 long grain (product of Ricoh Company, Ltd.) so that the toner was deposited in an amount of 0.40 mg/cm$^2$. In the formation of the images, the surface temperature of the fixing roller was changed, and whether offset, in which an image remaining after development of the solid image is fixed in other places than the intended places, occurred was observed to evaluate offset resistance. Note that, the lowest temperature at which no offset occurred is defined as a minimum fixing temperature.

[Evaluation Criteria for Cold Offset]

A: lower than 110° C.

B: 110° C. or higher but lower than 120° C.

C: 120° C. or higher but lower than 130° C.

D: 130° C. or higher

[Evaluation Criteria for Hot Offset]

A: 170° C. or higher

B: 160° C. or higher but lower than 170° C.

C: 150° C. or higher but lower than 160° C.

D: lower than 150° C.

<Heat Resistant Storage Stability>

Each of the toners was charged into a 50 mL-glass container, which was then left to stand in a thermostat bath of 50° C. for 24 hours, followed by cooling to 24° C. The thus-treated toner was measured for penetration degree according to the penetration test (JIS K2235-1991) and evaluated for heat resistant storage stability according to the following criteria.

[Evaluation Criteria]

A: The penetration degree was 20 mm or greater

B: The penetration degree was 15 mm or greater but less than 25 mm.

C: The penetration degree was 10 mm or greater but less than 15 mm.

D: The penetration degree was less than 10 mm.

<Glossiness>

An apparatus provided by modifying a fixing portion of copier MF2200 (product of Ricoh Company, Ltd.) using a TEFLON (registered trademark) roller as a fixing roller was used to perform a copy test on sheets of Type 6200 paper (product of Ricoh Company, Ltd.). Specifically, the fixing temperature was set to a temperature of 20° C.+the minimum fixing temperature determined in the evaluation of the low temperature fixing ability, and the paper-feeding linear velocity was set to 120 mm/sec to 150 mm/sec, the surface pressure was set to 1.2 kgf/cm$^2$, and the nip width was set to 3 mm. The image after the copy test was measured for 60-degree glossiness with glossmeter VG-7000 (product of NIPPON DENSHOKU INDUSTRIES Co., Ltd.).

[Evaluation Criteria]

A: 30% or more

B: 25% or more but less than 30%

C: 20% or more but less than 25%

D: less than 20%

<Image Density (Coloring Ability)>

Each of the developers was charged into a unit of IMAGIO MP C4300 (product of Ricoh Company, Ltd.) and a rectangular solid image of 2 cm×15 cm was formed on PPC paper sheets (Type 6000 <70W> A4 long grain (product of Ricoh Company, Ltd.) so that the toner was deposited in an amount of 0.40 mg/cm$^2$. In the formation of the images, the surface temperature of the fixing roller was set to 120° C. Next, using X-RITE938 (product of X-Rite Co.), the image density (ID) of the solid image was measured with status A mode and d50 light.

[Evaluation Criteria]

A: 1.5 or more

B: 1.4 or more but less than 1.5

C: 1.2 or more but less than 1.4

D: less than 1.2

Example 2

A toner of Example 2 was obtained in the same manner as in Example 1 except that the non-crystalline polyester resin A1 was changed to the non-crystalline polyester resin A2 in the <Preparation of master batch (MB)> and the <Preparation of oil phase>.

The obtained toner was evaluated in the same manner as in Example 1. The results are shown in Table 4.

Example 3

A toner of Example 3 in the same manner as in Example 1 except that the [ethyl acetate solution of non-crystalline polyester resin A4] was changed to the [ethyl acetate solution of non-crystalline polyester resin A5] in the <Preparation of oil phase>.

The obtained toner was evaluated in the same manner as in Example 1. The results are shown in Table 4.

Example 4

A toner of Example 4 in the same manner as in Example 1 except that the [ethyl acetate solution of non-crystalline polyester resin A4] was changed to the [ethyl acetate solution of non-crystalline polyester resin A6] in the <Preparation of oil phase>.

The obtained toner was evaluated in the same manner as in Example 1. The results are shown in Table 4.

Example 5

A toner of Example 5 in the same manner as in Example 1 except that the [ethyl acetate solution of non-crystalline polyester resin A4] was changed to the [non-crystalline polyester resin A7] in the <Preparation of oil phase>.

The obtained toner was evaluated in the same manner as in Example 1. The results are shown in Table 4.

Example 6

A toner of Example 6 in the same manner as in Example 1 except that the [ethyl acetate solution of non-crystalline polyester resin A4] was changed to the [ethyl acetate solution of non-crystalline polyester resin A8] in the <Preparation of oil phase>.

The obtained toner was evaluated in the same manner as in Example 1. The results are shown in Table 4.

Example 7

A toner of Example 7 in the same manner as in Example 1 except that the [ethyl acetate solution of non-crystalline polyester resin A4] was changed to the [ethyl acetate solution of non-crystalline polyester resin A9] in the <Preparation of oil phase>.

The obtained toner was evaluated in the same manner as in Example 1. The results are shown in Table 4.

Example 8

A toner of Example 8 in the same manner as in Example 1 except that the [ethyl acetate solution of non-crystalline polyester resin A4] was changed to the [ethyl acetate solution of non-crystalline polyester resin A10] in the <Preparation of oil phase>.

The obtained toner was evaluated in the same manner as in Example 1. The results are shown in Table 4.

Example 9

A toner of Example 9 in the same manner as in Example 1 except that the [ethyl acetate solution of non-crystalline polyester resin A4] was changed to the [ethyl acetate solution of non-crystalline polyester resin A11] in the <Preparation of oil phase>.

The obtained toner was evaluated in the same manner as in Example 1. The results are shown in Table 4.

Example 10

A toner of Example 10 in the same manner as in Example 1 except that the [ethyl acetate solution of non-crystalline polyester resin A4] was changed to the [ethyl acetate solution of non-crystalline polyester resin A12] in the <Preparation of oil phase>.

The obtained toner was evaluated in the same manner as in Example 1. The results are shown in Table 4.

Example 11

A toner of Example 11 in the same manner as in Example 1 except that the non-crystalline polyester resin A1 was changed to the non-crystalline polyester resin A3 in the <Preparation of master batch (MB)>, that the non-crystalline polyester resin A1 was changed to the non-crystalline polyester resin A3 in the <Preparation of oil phase>, and that the total amount of the non-crystalline polyester resin A3 was changed to 900 parts and the [ethyl acetate solution of non-crystalline polyester resin A4] and the [curing agent] were not added.

The obtained toner was evaluated in the same manner as in Example 1. The results are shown in Table 4.

Example 12

A toner of Example 12 was obtained in the same manner as in Example 1 except that the [crystalline polyester resin dispersion liquid] was not added in the <Preparation of oil phase> and the total amount of the [non-crystalline polyester resin A1] was changed to 800 parts.

The obtained toner was evaluated in the same manner as in Example 1. The results are shown in Table 4.

Comparative Example 1

A toner of Comparative Example 1 was obtained in the same manner as in Example 1 except that the [ethyl acetate solution of non-crystalline polyester resin A4] was changed to the [ethyl acetate solution of non-crystalline polyester resin A13] in the <Preparation of oil phase>.

The obtained toner was evaluated in the same manner as in Example 1. The results are shown in Table 4.

Comparative Example 2

A toner of Comparative Example 2 was obtained in the same manner as in Example 1 except that the [ethyl acetate solution of non-crystalline polyester resin A4] was changed to the [ethyl acetate solution of non-crystalline polyester resin A14] in the <Preparation of oil phase>.

The obtained toner was evaluated in the same manner as in Example 1. The results are shown in Table 4.

Comparative Example 3

A toner of Comparative Example 3 was obtained in the same manner as in Example 1 except that the [ethyl acetate solution of non-crystalline polyester resin A4] was changed to the [ethyl acetate solution of non-crystalline polyester resin A15] in the <Preparation of oil phase>.

The obtained toner was evaluated in the same manner as in Example 1. The results are shown in Table 4.

Comparative Example 4

A toner of Comparative Example 4 was obtained in the same manner as in Example 1 except that the [ethyl acetate solution of non-crystalline polyester resin A4] was changed to the [ethyl acetate solution of non-crystalline polyester resin A16] in the <Preparation of oil phase>.

The obtained toner was evaluated in the same manner as in Example 1. The results are shown in Table 4.

Comparative Example 5

A toner of Comparative Example 5 was obtained in the same as Example 1 except that the total amount of the [non-crystalline polyester resin A1] was changed to 600 parts and the amount of the [non-crystalline polyester resin A4] was changed to 300 parts in the <Preparation of oil phase>.

The obtained toner was evaluated in the same manner as in Example 1. The results are shown in Table 4.

Comparative Example 6

A toner of Comparative Example 6 was obtained in the same manner as in Example 1 except that the [ethyl acetate solution of non-crystalline polyester resin A4] was changed to the [ethyl acetate solution of non-crystalline polyester resin A17] in the <Preparation of oil phase>.

The obtained toner was evaluated in the same manner as in Example 1. The results are shown in Table 4.

Table 3 shows compositions of the toners of Examples 1 to 12 and Comparative Examples 1 to 6.

TABLE 3

| | Non-crystalline polyester resins | | | | Crystalline polyester resin B | Releasing agent | Pigment | Curing agent |
|---|---|---|---|---|---|---|---|---|
| | Unmodified | | Prepolymers | | | | | |
| | Kind | Parts by mass | Kind | Parts by mass | Parts by mass | Parts by mass | Parts by mass | Parts by mass |
| Ex. 1 | A1 | 750 | A4 | 150 | 50 | 50 | 50 | 2 |
| Ex. 2 | A2 | 750 | A4 | 150 | 50 | 50 | 50 | 2 |
| Ex. 3 | A1 | 750 | A5 | 150 | 50 | 50 | 50 | 2 |
| Ex. 4 | A1 | 750 | A6 | 150 | 50 | 50 | 50 | 2 |
| Ex. 5 | A1<br>A7 | 750<br>150 | None | 0 | 50 | 50 | 50 | 2 |
| Ex. 6 | A1 | 750 | A8 | 150 | 50 | 50 | 50 | 2 |
| Ex. 7 | A1 | 750 | A9 | 150 | 50 | 50 | 50 | 2 |
| Ex. 8 | A1 | 750 | A10 | 150 | 50 | 50 | 50 | 2 |
| Ex. 9 | A1 | 750 | A11 | 150 | 50 | 50 | 50 | 2 |
| Ex. 10 | A1 | 750 | A12 | 150 | 50 | 50 | 50 | 2 |
| Ex. 11 | A3 | 900 | None | 0 | 50 | 50 | 50 | 0 |
| Ex. 12 | A1 | 800 | A4 | 150 | 0 | 50 | 50 | 2 |
| Comp. Ex. 1 | A1 | 750 | A13 | 150 | 50 | 50 | 50 | 2 |
| Comp. Ex. 2 | A1 | 750 | A14 | 150 | 50 | 50 | 50 | 2 |
| Comp. Ex. 3 | A1 | 750 | A15 | 150 | 50 | 50 | 50 | 2 |
| Comp. Ex. 4 | A1 | 750 | A16 | 150 | 50 | 50 | 50 | 2 |
| Comp. Ex. 5 | A1 | 600 | A4 | 300 | 50 | 50 | 50 | 2 |
| Comp. Ex. 6 | A1 | 750 | A17 | 150 | 50 | 50 | 50 | 2 |

TABLE 4

| | Tg1st (° C.) | Tg2nd (° C.) | Cold offset | Hot offset | Heat resistant storage stability | Glossiness | Coloring ability |
|---|---|---|---|---|---|---|---|
| Ex. 1 | 44.4 | 24.7 | A | A | A | A | A |
| Ex. 2 | 35.4 | 21.3 | A | A | A | A | A |
| Ex. 3 | 45.6 | 24.8 | A | A | A | A | A |
| Ex. 4 | 44.9 | 25.4 | B | A | A | B | B |
| Ex. 5 | 28.4 | 12.4 | A | B | B | A | A |
| Ex. 6 | 45.2 | 23.6 | A | B | B | A | A |
| Ex. 7 | 46.3 | 26.1 | A | C | C | A | A |
| Ex. 8 | 45.4 | 26.6 | A | A | A | A | A |
| Ex. 9 | 47.2 | 29.4 | B | A | A | B | B |
| Ex. 10 | 48.7 | 32.1 | C | B | A | C | C |
| Ex. 11 | 28.4 | 10.5 | A | B | C | B | A |
| Ex. 12 | 44.4 | 42.1 | C | A | A | C | C |
| Comp. Ex. 1 | 44.6 | 25.3 | B | A | A | D | C |
| Comp. Ex. 2 | 40.2 | 20.2 | A | D | C | A | A |
| Comp. Ex. 3 | 37.8 | 23.2 | A | D | D | A | A |
| Comp. Ex. 4 | 49.3 | 27.8 | D | C | B | C | C |
| Comp. Ex. 5 | 17.4 | 8.4 | A | D | D | A | A |
| Comp. Ex. 6 | 54.0 | 3.43 | D | A | A | C | C |

Embodiments of the present invention are as follows, for example.

<1> A toner, including:

a polyester resin, wherein the polyester resin includes a diol component and a crosslink component as constituent components thereof, wherein the diol component contains an aliphatic diol having 3 to 10 carbon atoms in an amount of 50 mol % or more, wherein the crosslink component contains a trihydric or higher aliphatic alcohol, and wherein the toner has a glass transition temperature (Tg1st) of 20° C. to 50° C., where the glass transition temperature (Tg1st) is measured in first heating in differential scanning calorimetry (DSC) of the toner.

<2> The toner according to <1>, wherein the crosslink component constituting the polyester resin is a trihydric or tetrahydric aliphatic alcohol.

<3> The toner according to <1> or <2>, wherein the number of carbon atoms of a main chain of the diol component constituting the polyester resin is an odd number, and the diol component contains an alkyl group in a side chain thereof.

<4> The toner according to any one of <1> to <3>, further including a crystalline polyester resin.

<5> The toner according to any one of <1> to <4>, wherein the polyester resin includes a dicarboxylic acid component as the constituent component thereof, and the dicarboxylic acid component contains an aliphatic dicarboxylic acid having 4 to 12 carbon atoms in an amount of 50 mol % or more.

<6> The toner according to any one of <1> to <5>, wherein the polyester resin includes a urethane bond, a urea bond, or both.

<7> The toner according to any one of <1> to <6>, wherein the toner has a glass transition temperature (Tg2nd) of 0° C. to 30° C., where the glass transition temperature (Tg2nd) is measured in second heating in differential scanning calorimetry (DSC) of the toner, and the Tg1st is higher than the Tg2nd.

<8> A developer, including:

the toner according to any one of <1> to <7>; and a carrier.

<9> An image forming apparatus, including:

an electrostatic latent image bearing member;

an electrostatic latent image forming unit configured to form an electrostatic latent image on the electrostatic latent image bearing member;

a developing unit containing a toner and configured to develop the electrostatic latent image formed on the electrostatic latent image bearing member to form a visible image, wherein the toner is the toner according to any one of <1> to <7>.

The invention claimed is:

1. A toner, comprising:

a polyester resin, wherein the polyester resin comprises a diol component and a crosslink component as constituent components thereof, wherein the diol component comprises an aliphatic diol having 3 to 10 carbon atoms in an amount of 50 mol % or more, wherein the crosslink component comprises a trihydric or higher aliphatic alcohol, and wherein the toner has a glass transition temperature (Tg1st) of 20° C. to 50° C., where the glass transition temperature (Tg1st) is measured in first heating in differential scanning calorimetry (DSC) of the toner.

2. The toner according to claim 1, wherein the crosslink component constituting the polyester resin is a trihydric or tetrahydric aliphatic alcohol.

3. The toner according to claim 1, wherein the number of carbon atoms of a main chain of the diol component constituting the polyester resin is an odd number, and the diol component comprises an alkyl group in a side chain thereof.

4. The toner according to claim 1, further comprising a crystalline polyester resin.

5. The toner according to claim 1, wherein the polyester resin comprises a dicarboxylic acid component as the constituent component thereof, and the dicarboxylic acid component comprises an aliphatic dicarboxylic acid having 4 to 12 carbon atoms in an amount of 50 mol % or more.

6. The toner according to claim 1, wherein the polyester resin comprises a urethane bond, a urea bond, or both.

7. The toner according to claim 1, wherein the toner has a glass transition temperature (Tg2nd) of 0° C. to 30° C., where the glass transition temperature (Tg2nd) is measured in second heating in differential scanning calorimetry (DSC) of the toner, and the Tg1st is higher than the Tg2nd.

8. A developer, comprising:

a toner; and a carrier, wherein the toner comprises a polyester resin, wherein the polyester resin comprises a diol component and a crosslink component as constituent components thereof, wherein the diol component comprises an aliphatic diol having 3 to 10 carbon atoms in an amount of 50 mol % or more, wherein the crosslink component comprises a trihydric or higher aliphatic alcohol, and wherein the toner has a glass transition temperature (Tg1st) of 20° C. to 50° C., where the glass transition temperature (Tg1st) is measured in first heating in differential scanning calorimetry (DSC) of the toner.

9. An image forming apparatus, comprising:

an electrostatic latent image bearing member;

an electrostatic latent image forming unit configured to form an electrostatic latent image on the electrostatic latent image bearing member;

a developing unit comprising a toner and configured to develop the electrostatic latent image formed on the electrostatic latent image bearing member to form a visible image, wherein the toner comprises a polyester resin, wherein the polyester resin comprises a diol component and a crosslink component as constituent components thereof, wherein the diol component comprises an aliphatic diol having 3 to 10 carbon atoms in an amount of 50 mol % or more, wherein the crosslink component comprises a trihydric or higher aliphatic alcohol, and wherein the toner has a glass transition temperature (Tg1st) of 20° C. to 50° C., where the glass transition temperature (Tg1st) is measured in first heating in differential scanning calorimetry (DSC) of the toner.

* * * * *